US007048474B2

(12) United States Patent
Tabler

(10) Patent No.: US 7,048,474 B2
(45) **Date of Patent: *May 23, 2006**

(54) APPARATUS AND METHOD FOR EFFICIENTLY FABRICATING, DISMANTLING AND STORING A POROUS TUBULAR WINDBLOWN PARTICLE CONTROL DEVICE

(76) Inventor: Ronald D. Tabler, 7505 Estate Cir., Longmont, CO (US) 80503

( * ) Notice: Subject to any disclaimer, the term of this patent is extended or adjusted under 35 U.S.C. 154(b) by 0 days.

This patent is subject to a terminal disclaimer.

(21) Appl. No.: 10/961,849

(22) Filed: Oct. 7, 2004

(65) Prior Publication Data

US 2006/0002772 A1 Jan. 5, 2006

Related U.S. Application Data

(63) Continuation of application No. 10/882,123, filed on Jun. 30, 2004.

(51) Int. Cl.
*E01F 7/00* (2006.01)

(52) U.S. Cl. ..... 405/302.7; 405/302.6; 256/12.5

(58) Field of Classification Search ..... 405/302.6, 405/302.7, 15, 21, 22, 32; 256/12.5
See application file for complete search history.

(56) References Cited

U.S. PATENT DOCUMENTS

| | | | |
|---|---|---|---|
| 361,783 | A | 4/1887 | Rudnicki |
| 490,545 | A | 1/1893 | Dixson |
| 1,108,943 | A | 9/1914 | Swezey |
| 1,175,962 | A | 3/1916 | Latham |
| 1,281,021 | A | 10/1918 | Kellner |
| 1,281,022 | A | 10/1918 | Kellner |
| 1,355,051 | A | 10/1920 | Kellner |
| 1,373,629 | A | 4/1921 | Nohlen |
| 1,487,668 | A | 3/1924 | Rehfeld |
| 1,489,647 | A | 4/1924 | Nohlen |
| 1,541,241 | A | 6/1925 | Baxter |
| 1,545,909 | A | 7/1925 | McKinnon |
| 1,595,946 | A | 8/1926 | Kellner |

(Continued)

FOREIGN PATENT DOCUMENTS

| | | |
|---|---|---|
| DK | 61263 | 8/1943 |

(Continued)

OTHER PUBLICATIONS

Tabler, Ronald D., *Design Guidelines for the Control of Blowing and Drifting Snow*, 1994; Figs. 2.8 and 2.9, pp. 15-16; Section 3.6 Snow Deposition and Retention Due to Vegetation, pp. 58-59; and Section 5.3.9.2 The Tensar Portable Fence, pp. 219-222.

*Primary Examiner*—Frederick L. Lagman
(74) *Attorney, Agent, or Firm*—John R. Ley

(57) ABSTRACT

A windblown particle control device which, when attached to the surface of the earth assumes a generally tubular cross-sectional shape, stabilizes particle cover and controls deposition and retention of windblown particles. A sheet of netting material is curved in an arched configuration. Webs of the sheet are linked together to define apertures through the sheet. The apertures create aerodynamic effects in the wind which stabilize, deposit and retain the particles on the earth surface. A kit of components, which includes the netting sheet and a plurality of frame structures to support and maintain the netting sheet in the arched configuration may be employed to assemble the control device for use.

113 Claims, 13 Drawing Sheets

U.S. PATENT DOCUMENTS

| | | | | | |
|---|---|---|---|---|---|
| 1,627,623 | A | | 5/1927 | Smith | |
| 1,635,899 | A | | 7/1927 | Nohlen | |
| 1,668,651 | A | | 5/1928 | McKinnon | |
| 1,819,305 | A | | 8/1931 | Snyder | |
| 1,969,123 | A | | 8/1934 | Doble | |
| 2,032,582 | A | | 3/1936 | Lashmet | |
| 2,082,707 | A | | 6/1937 | Mahon | |
| 2,092,183 | A | * | 9/1937 | Rehfeld | 405/19 |
| 2,135,337 | A | | 11/1938 | Herbest, Jr. | |
| 2,248,721 | A | | 7/1941 | Rehfeld | |
| 2,263,313 | A | | 11/1941 | Rehfeld | |
| 2,306,737 | A | | 12/1942 | MacDonald | |
| 2,378,865 | A | | 6/1945 | Rehfeld | |
| 2,803,113 | A | | 8/1957 | Hoad | |
| 2,803,437 | A | | 8/1957 | Borges | |
| 3,218,035 | A | | 11/1965 | Dunlap | |
| 3,226,091 | A | | 12/1965 | Root | |
| 3,540,587 | A | | 11/1970 | Dawbarn | |
| 3,844,124 | A | | 10/1974 | Tupper | |
| 3,913,889 | A | | 10/1975 | Nugent et al. | |
| 3,966,172 | A | | 6/1976 | Garrett | |
| 4,335,868 | A | | 6/1982 | Ribbert | |
| 4,339,114 | A | | 7/1982 | Deike | |
| 4,388,019 | A | | 6/1983 | Kajihara | |
| 4,439,059 | A | | 3/1984 | Kikuzawa et al. | |
| 4,529,173 | A | | 7/1985 | Kramer et al. | |
| 4,549,724 | A | | 10/1985 | Taillandier | |
| 4,932,634 | A | | 6/1990 | Sura | |
| 4,947,791 | A | | 8/1990 | Laier et al. | |
| 4,954,013 | A | | 9/1990 | Lamberton | |
| 5,039,250 | A | | 8/1991 | Janz | |
| 5,123,780 | A | | 6/1992 | Martinsen | |
| 5,131,630 | A | | 7/1992 | Nash | |
| 5,184,800 | A | | 2/1993 | Tabler | |
| 5,405,217 | A | * | 4/1995 | Dias et al. | 405/302.6 |
| D360,476 | S | | 7/1995 | Smeja et al. | |
| 5,556,229 | A | | 9/1996 | Bishop et al. | |
| 5,605,416 | A | * | 2/1997 | Roach | 405/21 |
| 5,901,507 | A | | 5/1999 | Smeja et al. | |
| 6,497,532 | B1 | | 12/2002 | McGinn | |
| 6,616,383 | B1 | | 9/2003 | Janz | |
| 6,824,681 | B1 | | 11/2004 | Engwer | |

FOREIGN PATENT DOCUMENTS

| | | |
|---|---|---|
| DK | 81858 | 9/1956 |
| DK | 85909 | 10/1958 |
| FR | 2625520 | 7/1989 |
| JP | 5997909 | 6/1984 |
| JP | 2289705 | 11/1990 |
| JP | 6264415 | 9/1994 |
| JP | 841830 | 2/1996 |
| JP | 8109616 | 4/1996 |
| JP | 8277008 | 10/1996 |
| JP | 11229331 | 8/1999 |
| SU | 629277 | 9/1978 |
| SU | 687164 | 10/1979 |

* cited by examiner

APPARATUS AND METHOD FOR EFFICIENTLY FABRICATING, DISMANTLING AND STORING A POROUS TUBULAR WINDBLOWN PARTICLE CONTROL DEVICE

CROSS-REFERENCE TO RELATED APPLICATION

This is a continuation in part of an invention for a Porous Tubular Device and Method for Controlling Windblown Particle Stabilization Deposition and Retention, described in U.S. patent application Ser. No. 10/882,123, filed Jun. 30, 2004 by the inventor hereof. The subject matter of this prior-filed application is incorporated herein by this reference.

FIELD OF THE INVENTION

This invention relates to controlling the deposition and retention of windblown particles, such as snow, sand or soil. More particularly, the present invention relates to a new and improved windblown particle control device and method which utilizes a three-dimensional porous tubular configuration to effectively control the deposition, retention and stabilization of windblown particles, and further, which offers the advantages of relatively inexpensive fabrication, efficient assembly, easy deployment, quick dismantlement, and convenient and space-efficient storage when not in use, among other things.

BACKGROUND OF THE INVENTION

Windblown snow, sand, and dust can create hazardous driving conditions by reducing visibility and forming drifts on roadways to block or impede traffic movement. Blowing snow also causes icy roads, which are a major cause of vehicle accidents. Blowing snow also causes significant problems on railroads by forming drifts that block the passage of trains where tracks pass through cuts in hills, and by clogging switches and interfering with the operation of electronic sensors for detecting over-heated journals and dragging equipment.

To alleviate the problems created by blowing and drifting snow, snow control devices in the form of snow fences and other structures have been used for many years. A snow fence causes the wind-borne snow crystals or particles to settle out of the wind in a protected or sheltered area other than at a critical area, such as a roadway or railroad tracks where snow accumulation is not wanted.

The typical construction of a snow fence is a two-dimensional panel with a series of slots, holes or openings formed through the panel to create porosity. The snow fence creates aerodynamic drag and alters the structure of the turbulence which slows the velocity of the wind and diminishes its capacity to carry snow. In addition, a porous snow fence reduces the scale of turbulence by breaking up large eddies into smaller ones. These effects on the airflow allow the suspended particles to settle out and accumulate in the protected area which is sheltered by the snow fence. In the case of a porous fence, most of this deposition occurs on the downwind side of the barrier or panel. By positioning the snow fence far enough away from the roadway, the snow settles out of the wind at the sheltered or protected area, so the wind is relatively free of snow at the adjoining critical area. However, because the wind will pick up additional snow particles by blowing over expanses of snow-covered ground, the snow fence and its protected area must be close enough to the critical area to prevent the wind from accumulating snow again before reaching the critical area. Otherwise, the placement of the snow fence will be ineffective in preventing snow accumulation on the roadway or critical area.

Typically, the panels of a snow fence are assembled in long continuous rows. Long continuous rows of the artificial panel structures are usually necessary to achieve the best snow and windblown particle control effects over relatively long expanses of critical areas such as roadways and railroad tracks. The panels are typically constructed of wood planks and/or steel or plastic sheeting. Posts or triangular support frame structures anchor the panels to the ground and hold them upright to confront and withstand the forces from the wind. Because of their relative massive, complex and sturdy nature, conventional snow fences are usually built in place at the location of use. The bulky nature of the materials used to construct such snow fences usually makes their fabrication a time-consuming exercise. In addition to being bulky, the construction materials are usually expensive and difficult to transport to the construction site of the snow fence. The typical end result of constructing such snow fences is a collection of immobile, expensive and artificial structures which are visually obtrusive and aesthetically objectionable in a natural environment.

While it is theoretically possible to remove the snow fences during the seasons of the year when they are not needed, and thereby avoid the objectionable environmental obtrusion during some parts of the year, the cost of dismantling a typical snow fence and reassembling the snow fence when or where it is needed, becomes a predominant deterrent, resulting in the snow fence remaining in place on a year-around basis. The same considerations apply with respect to moving those snow fences which have not been placed in an optimal position to prevent snow from drifting and accumulating in the critical area. Empirical experience may be required to obtain the optimal placement of a snow fence.

The cost of dismantling a snow fence is approximately the same as the considerable cost of fabricating the snow fence in the first place. Then, the dismantled snow fence must be reconstructed, again at a further cost approximately equal to the original fabrication cost. The time required to dismantle a snow fence may be slightly less than the time required to fabricate the snow fence in the first instance, but the time requirements are nevertheless considerable and significant. The relatively permanent posts and anchoring structures used to hold the snow fence panels to the ground are usually not removable, even though the panels which create the aerodynamic effects might be removed from the anchoring posts and structures.

Even ignoring the substantial expense and time required to disassemble a conventional snow fence, the relatively large amount of bulky material from which the snow fence is fabricated must be stored until the time when the snow fence is again reassembled. The amount of material and the transportation costs of those materials between the site of use and the storage location creates additional problems and difficulties. The amount of space required to stow the numerous and bulky constituent materials of a typical wooden panel snow fence is substantial. Use of that space for storage constitutes an additional cost associated with disassembling a snow fence and is therefore an added detriment to dismantling conventional snow fence during those times of the year when it is not needed.

Because of the negative impacts of the cost, obtrusiveness, fabrication, dismantlement, removal and storage issues described above, previous artificial snow fences and windblown particle control structures have not been used on a prevalent basis for other beneficial purposes such as accumulating snow in agricultural fields to increase the soil moisture content for growing crops, retaining the topsoil against wind erosion, or shielding immature plants from the shear stress of wind and from the rapid evaporation of soil moisture at their critical early-growth stages. These and other potentially beneficial uses of windblown particle control devices would become more prevalent if the costs of the windblown particle control devices were reduced to enable the more cost-effective uses of such control devices over large expanses of the agricultural fields, and if such control devices could be fabricated and dismantled on a convenient, cost-effective and efficient basis. Dismantling such control devices and removing them from agricultural fields is essential after stable plant growth has been established to permit harvesting the crops, among other things.

Many other disadvantages associated with the deployment of snow fences and windblown particle control devices are known and appreciated. The disadvantages associated with the use of conventional snow fences have led to the significant improvements of the present invention.

SUMMARY OF THE INVENTION

The present invention is directed to a very effective porous tubular windblown particle control device which is fabricated relatively inexpensively and quickly from relatively inexpensive and readily-available materials. The nature and configuration of the windblown particle control device allows it to be positioned and erected quickly and efficiently, and to be dismantled in an equally quick and efficient manner. The ability to quickly and efficiently erect and dismantle the windblown particle control devices offers a realistic opportunity for it to be dismantled completely during those times of the year when it is not needed, or to be dismantled and then reassembled at a different position to obtain optimum windblown particle control effects on critical areas such as roadways or railroad tracks. Furthermore, the nature of the materials from which the control device is fabricated permit those materials to be transported and stored efficiently without consuming a large amount of storage space. The nature of the materials from which the control device is constructed are not bulky or heavy, thereby allowing those materials to be transported conveniently to and from the location of use. A lesser number of persons are required to fabricate and erect the control devices, or the control devices can be erected more quickly with the same number of people. The convenience of dismantling and storing the windblown particle control devices reduces or eliminates the principal reasons for permitting an aesthetic obtrusion to the natural environment during those portions of the year when the control devices are not needed. The relatively low expense of the materials necessary to fabricate the control device, and the relatively low costs of erecting and dismantling the control device, and the convenience of storing the materials when the control device is not needed, facilitate the use of the windblown particle control device in circumstances which were not previously considered as advantageous, such as for accumulating snow in agricultural fields to increase the soil moisture content for growing crops, retaining the topsoil against wind erosion, and shielding immature plants from the shear stress of wind and from the rapid evaporation of soil moisture at their critical early-growth stages.

These and other beneficial improvements, uses, effects and consequences of the present invention are realized in a windblown particle control device which, when attached to the surface of the earth, stabilizes particle cover and controls deposition and retention of windblown particles. The windblown particle control device comprises a sheet of netting material curved in an arched configuration to establish a generally tubular cross-sectional shape upon contact with the earth surface. The sheet comprises a plurality of webs linked together to define apertures between the webs and through the sheet. The wind flowing through the apertures reduces in velocity and alters the turbulence effects to create aerodynamic effects which stabilize, deposit and retain the particles on the earth surface in a protected area. Frame structures may be attached to or made integral with the sheet of netting material to establish or help establish the sheet in the tubular configuration with respect to the earth surface.

The sheet may be connected to the frame structures by weaving a portion of the frame structures through apertures on opposite sides of webs within the sheet. The frame structures may be generally straight when woven through the apertures, and then bent to establish the arched configuration and tubular shape with respect to the earth. The sheet of netting material may have sufficient inherent strength to self-support and self-maintain the arched configuration to establish the generally tubular cross-sectional shape, in which case the frame structures are integral with the sheet. Geogrid, geotextile or cured synthetic composite material, such as fiberglass, may provide sufficient strength to self-support and self-maintain the sheet and the frame structures in the arched configuration.

Each straight frame structure may be resiliently bendable, in which case ends of the frame structure are retained to the earth surface to maintain the arched configuration. Disconnection of the frame structures from the earth surface allows its resiliency to establish the substantially straight elongated characteristic of the frame structure and a substantially planar characteristic of the sheet with which the frame structures are connected or woven. A plurality of the substantially planar sheets may be stacked on top of one another while the straight frame structures are woven through its apertures, or the substantially planar sheet may be rolled into a roll while the straight frame structures are woven through its apertures, thereby allowing the particle control device to be conveniently dismantled and stored. The relative ease of dismantling and storing the control device facilitates its removal during those times the year when it is not needed, as well as facilitating its relatively easy and quick assembly and take-down.

The frame structures can also be bent into the desired shape, and straightened from the desired shape when the control device is taken down. The frame structures can also be of preformed geometric configurations, such as a D-shape or a U-shape. Preferably, the sheet has a longitudinal dimension which is multiple times greater than its transverse dimension, thereby allowing one relatively long control device to be formed from a lengthy sheet of the netting material.

The quick, efficient and relatively inexpensive fabrication of the control device is facilitated by a kit of components to be connected together to form the porous tubular windblown particle control device. The kit includes a sheet of the netting material and a plurality of frame structures to support and maintain the sheet of netting material in an arched configuration which establishes the generally tubular cross-sectional shape. A plurality of fasteners may also be included in the kit to attach the frame structures to the surface of the earth. Anchor elements may be supplied in the kit to connect and retain the frame structures to the earth surface.

A method of assembling a porous tubular windblown particle control device from the kit is also part of the invention. The method involves connecting the plurality of frame structures to the sheet of netting material and orienting the frame structures to extend upward from the surface of the earth in an arched configuration to support and maintain the sheet of netting material in the generally tubular cross-sectional shape.

The invention also involves a method of controlling particle cover stabilization and deposition and retention of particles blown by wind in a location on an earth surface that is to be protected. The control device is located relative to the area that is to be protected, positioned with a longitudinal axis of the tubular configuration extending generally parallel to the earth surface, and oriented with the tubular configuration of the sheet to confront the wind and cause the wind blown particles to flow through the apertures of two vertically oriented portions of the tubular configuration of the sheet and create aerodynamic effects which stabilize, deposit and retain the particles on the earth surface in the protected area. Preferably the longitudinal axis of the tubular configuration is oriented generally perpendicular to a prevailing wind direction. A plurality of the control devices are connected in a row to deposit, stabilize, and retain the windblown particles in a protected area that is larger than the area capable of being protected by a single control device.

A more complete appreciation of the scope of the invention and the manner in which it achieves the above-noted and other beneficial effects, advantages and improvements can be obtained by reference to the following detailed description of presently preferred embodiments of the invention taken in connection with the accompanying drawings, which are briefly summarized below, and by reference to the appended claims.

DETAILED DESCRIPTION

Figure 1:
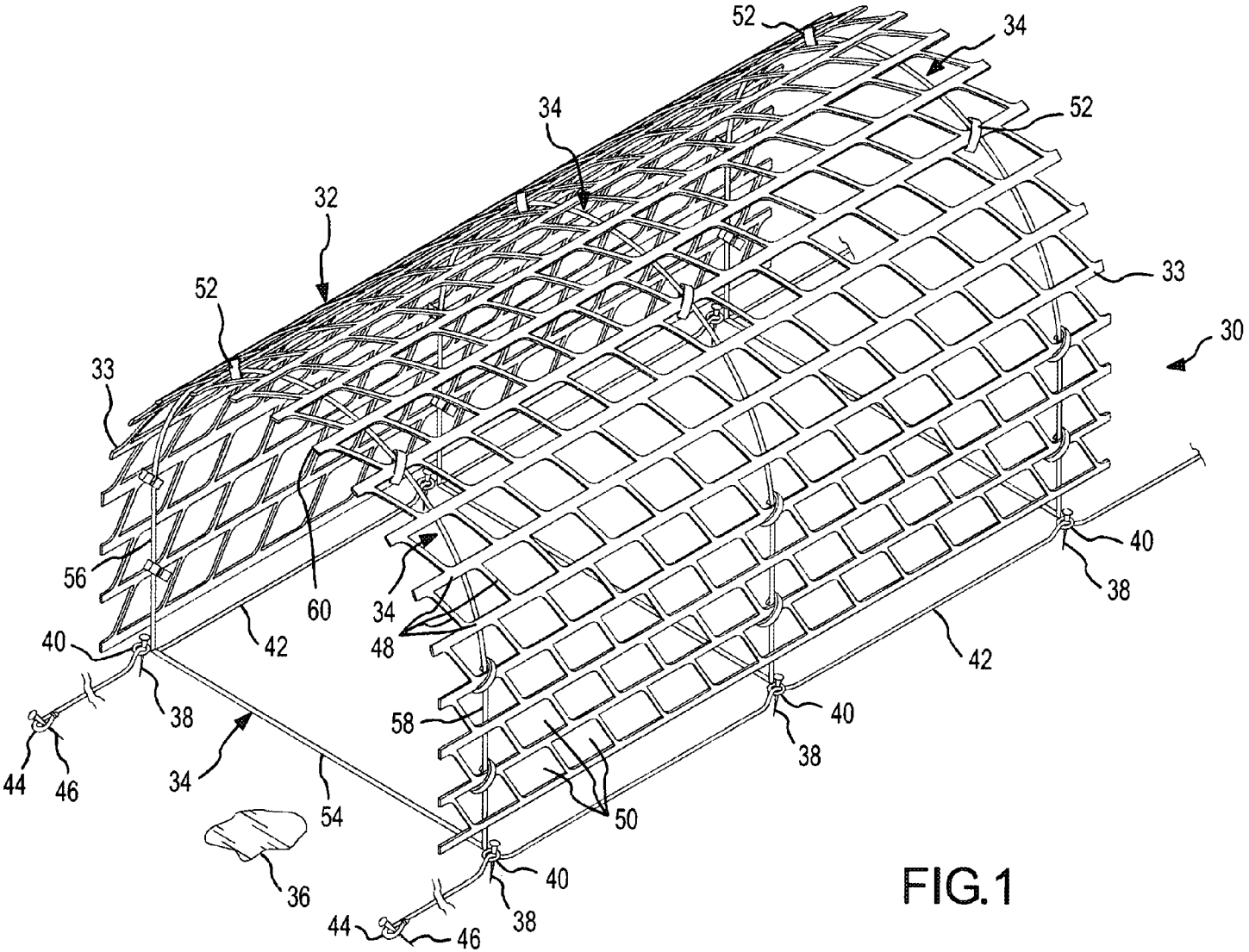
FIG. 1 is a perspective view of a porous tubular windblown particle control device which incorporates the present invention.
Figure 2:
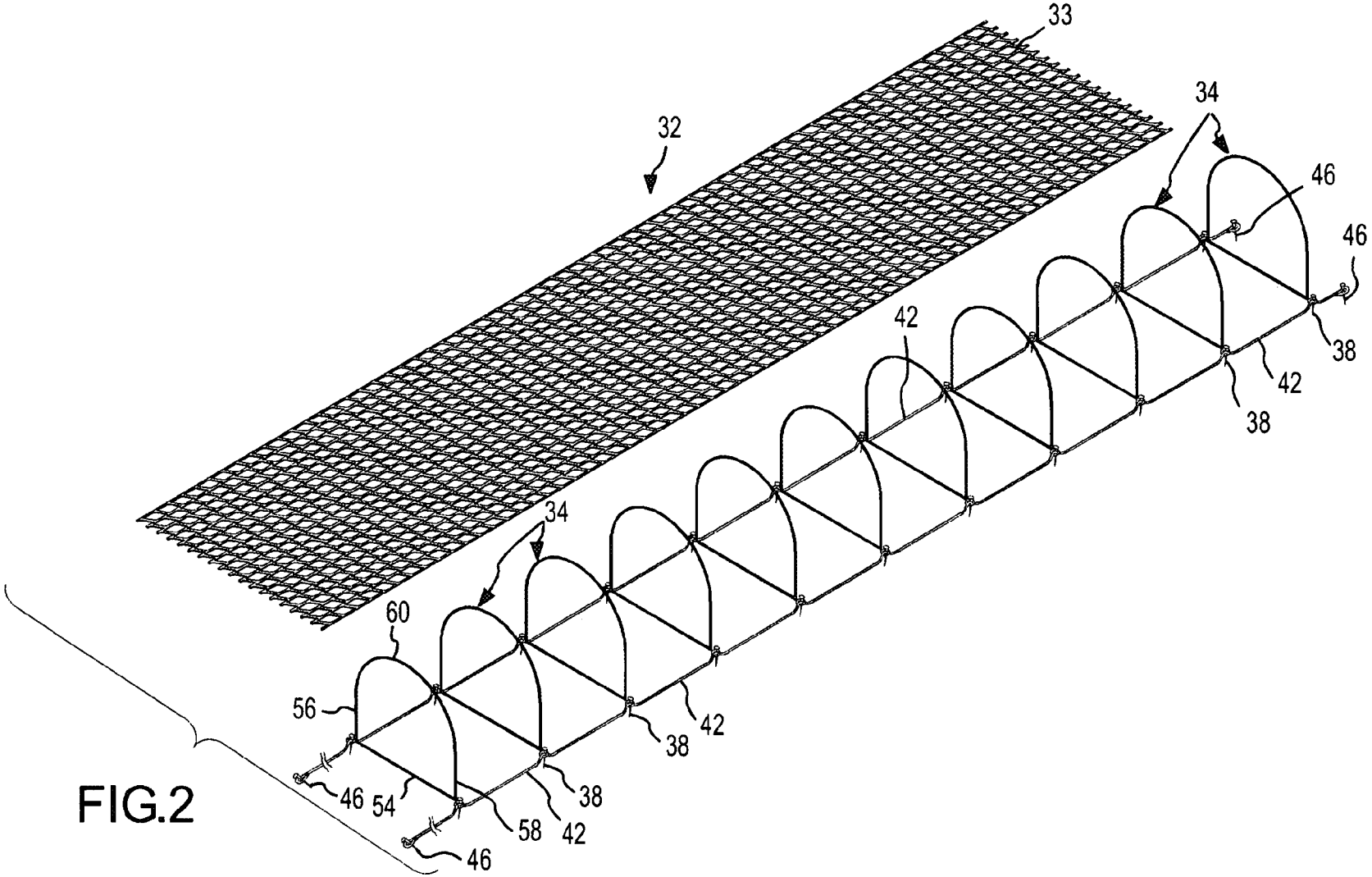
FIG. 2 is a perspective view of constituent components used in fabricating a windblown particle control device similar to that shown in FIG. 1 but having a relatively greater length than the control device shown in FIG. 1.
Figure 3:
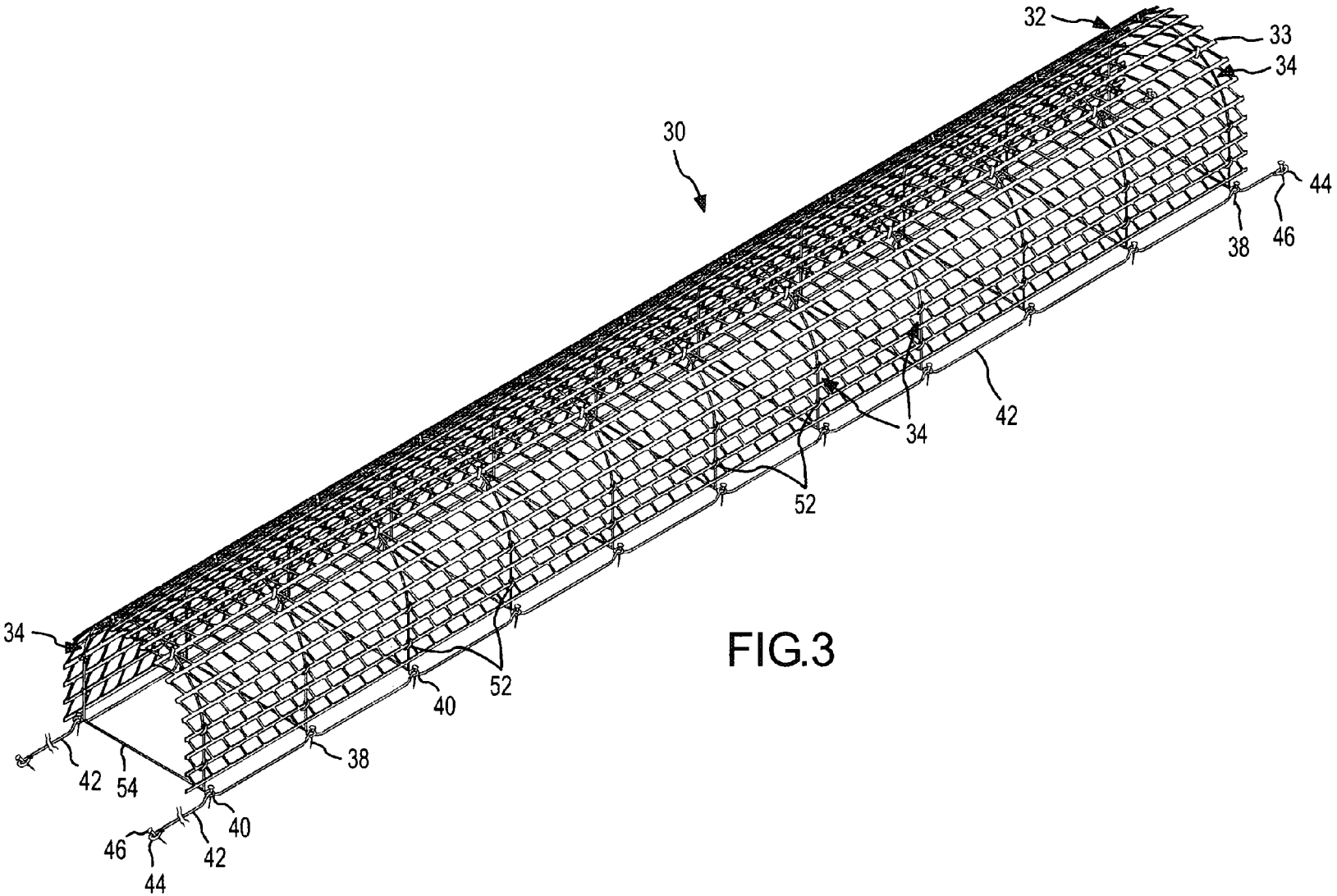
FIG. 3 is a perspective view of the control device fabricated from the constituent components shown in FIG. 2.

One form of a porous tubular windblown particle control device 30 incorporating the present invention is shown in FIGS. 1–3. The control device 30 is generally formed by a sheet 32 of conventional, flexible, plastic netting material 33 which is connected to and supported by a support structure formed from a plurality of D-shaped frame structures 34 that are longitudinally spaced apart from one another in a series along the length of the netting sheet 32. The strength of the sheet 32 of netting material 33 and the D-shaped frame structures 34 establish and maintain the general overall three-dimensional tubular shape and configuration of the device 30.

The device 30 is secured in a desired position on the earth surface or ground 36 or other earth surface by an anchor system which includes frame spikes 38 that are inserted through anchor elements or loops 40 formed in the frame structures 34. The frame spikes 38 are driven through the anchor loops 40 and into the ground 36 to secure the frame structures 34 and thus the entire device 30 to the ground. The anchor system may also include at least one longitudinal restraint element, such as a wire or cable 42, that connects to the frame structures 34, such as by extending through the anchor loops 40 along with the frame spikes 38. Opposite longitudinal ends of the restraint cable 42 are formed with restraint connectors or loops 44 into which restraint spikes 46 are inserted and driven into the ground 36. The longitudinal restraint cable 42 functions primarily as secondary anchoring to maintain the device 30 from blowing away, if the primary anchoring from the frame spikes 38 is lost.

The principal use of all forms of the porous tubular windblown particle control devices of the present invention, is to stabilize snow cover, and to control and retain windblown snow. Controlling and retaining or stabilizing windblown snow is very important to keeping roadways passable to traffic by preventing snow drifts and large accumulations which block the roadways to traffic flow. Controlling and retaining windblown snow is equally or more important in preventing icing on roadways, as would occur by the continuous sifting of snow across the roadway where the snow melts and then refreezes to form ice. Ice on roadways causes or contributes to vehicle crashes because of the inability of drivers to control their vehicles under icing conditions.

These and other effects are achieved by diminishing the velocity of the wind and altering turbulence in the airflow due to the characteristics and shape of the netting sheet 32. The diminished wind velocity and altered turbulence causes the windblown particles to settle out of the airflow to the ground 36 where they are retained in a protected area due to the diminished wind velocity and altered airflow turbulence. The protected area extends upwind and downwind of the control devices, and may attain a total length of approximately 40 times the height of the control device.

The sheet 32 of netting material exhibits sufficient strength to withstand the wind and to alter turbulence effects within the wind. The strength of the netting sheet 32 is sufficient to support the small amount of particles that might accumulate on the netting sheet 32 under conditions of still-wind particle deposition. The material 33 of the netting sheet 32 may be a conventional extruded plastic netting material currently manufactured by Masternet, Ltd. of Mississauga, Ontario, Canada, under the trademark "Vexar," and previously manufactured by Dupont Liquid Packaging Systems of Whitby, Ontario, Canada.

Each sheet 32 of netting material 33 is formed by a plurality of linked webs 48 which connect together to define apertures 50 between the webs 48. The size of the apertures 50 is considerably greater than the size of the webs 48. The webs 48 and the apertures 50 create the netting characteristic of each sheet 32 of material 33. The netting material may be fabricated in long or sizable pieces, with the larger pieces cut to the size of the smaller sheets 32 suitable for each device 30.

Each of the webs 48 has a three-dimensional characteristic, with significant length, width and thickness dimensions. The width and thickness dimensions of the webs 48 are primarily responsible for the strength of the netting sheets 32. The thickness dimension (measured perpendicular to the plane of a flat sheet of the netting material) of each web 48 creates enough strength to self-support the netting sheet 32 between the frame structures 34, to resist the forces from wind-loading, and to maintain the overall tubular configuration of the device 30.

The apertures 50 in the netting sheet 32 are relatively large and allow most snowfall to pass through those apertures 50 without accumulating on the webs 48. The strength of the webs 48 is sufficient to resist that small amount of snow which may accumulate on them, without substantially deforming the overall shape of the device 30. The apertures 50 also reduce the velocity of the horizontally-blowing wind and alter the turbulence to cause the snow to settle in the protected area near the device 30.

The width, thickness and length of each web 48 is substantially nonuniform among substantially all of the other webs 48 of sheets 32 of extruded plastic netting material. For example, the width, thickness and length of the webs 48 will typically average within the ranges of about ¾–1, ¼–½ and 3–4 inches, respectively. Similarly, the cross-sectional area occupied by each aperture 50 typically averages about 10 square inches. Consequently, the porosity of the sheet 32 of netting material 33 generally falls within the range of 50%.

The uneven and nonuniform width, thickness and length dimensions of the webs 48 contribute to altering the turbulence and reducing the velocity of the wind blowing through the device 30. However, netting sheets with uniform webs and apertures can be employed, provided that alternative material has adequate strength capability to resist deformation by wind and the weight of snow fall accumulating thereon. Examples of netting sheets with uniform webs and apertures include geotech grid, geotextile, thick punched and drawn sheeting and/or porous, perforated or apertured sheets of relatively rigid fiberglass or similar composite material which has been shaped during fabrication into the desired shape. The reduction in velocity and the turbulence effects cause the removal of a significant portion of the windblown particles from the wind, and the deposition of the removed windblown particles adjacent to the device 30. The removed particles are retained on the ground 36 substantially in the protected area where they are deposited upwind and downwind near the device 30, due to the reduction in wind velocity and turbulence effects in the protected area near the ground 36.

Because of the tubular shape of the device 30, the relatively large apertures 50, and the three-dimensional nature of the webs 48, the device 30 maintains its ability to induce deposition of windblown particles through a wide range of wind direction angles relative to its longitudinal axis. The three-dimensional nature of the device 30 makes it much more effective than conventional two-dimension snow fence when winds are aligned with the longitudinal axis. This capability to control windblown particles through a relatively wide range of wind direction angles offers a significant advantage over most conventional snow fences which are functional only over a considerably narrower range of wind direction angles. The color of the sheets 32 of netting material 33 may also be selected to blend with the natural environment in which the devices 30 are placed, thereby minimizing negative aesthetic impacts on the environment. This again is an advantage over conventional snow fences which are generally mechanical-appearing, obtrusive in appearance and incapable of blending with the natural environment.

The above-described advantages achieved by the extruded plastic netting material 33. These were comparable advantages cannot be achieved, or cannot be achieved to the significant degree as obtained by the present invention, by thin-sheet plastic netting material. Such thin sheet material generally lacks the strength and durability to support itself between the frame structures and to withstand the wind loading necessary to reduce the wind velocity and alter the turbulence. The porosity and dimensions of the thin sheet material are not as effective in creating the beneficial wind velocity reduction and turbulence altering effects as are the thicker dimensions and characteristics of the webs 48 and apertures 50 of the netting sheet 32. In addition, the thin sheet material is generally incapable of supporting the weight of accumulated snow.

The extruded netting sheet 32 is attached to the D-shaped frame structures 34 by netting connectors 52. Each connector 52 is preferably a short length of relatively heavy gauge steel wire that is wrapped around one of the webs 48 and one of the frame structures 34. For example, each connector may take the form of a conventional "hog-ring" that is bent to enclose a web 48 around the frame structure 34. The netting connectors 52 can also be a resilient plastic clip, strap or other material that does not break down or decompose when exposed to weather and sunlight and which is strong enough to hold the netting sheet 32 to the frame structures 34 under substantial wind conditions. The netting connectors 52 connect the webs 48 of the netting sheet 32 to each structure 34 at a multiplicity of spaced apart points along each frame structure 34. The frame structures 34 may have V-shaped notches, indentions or other restraints (not shown) formed along their length which provide attachment points for the connectors 52. Such notches, indentions or restraints secure the connectors 52 in position on the frame structure 34 to maintain the position of the netting sheet 32 without slipping on the frame structures 34.

Each frame structure 34 is formed generally in the outer peripheral shape of an alphabetical letter "D," as shown in FIGS. 1–3. The D-shaped frame structure 34 has a straight base portion 54 which contacts and extends along the ground 36, two relatively straight leg portions 56 and 58 which extend substantially perpendicularly from the base portion 54 and vertically from the ground 36, and a semicircular portion 60 which connects the upper ends of the leg portions 56 and 58 with its concave side facing the base portion 54. The portions 54, 56, 58 and 60 establish an open center through the D-shaped frame structure 34. The size and configuration of all of the D-shaped frame structures 54 in each device 30 are essentially identical, and are also preferably identical among different devices 30.

With the netting sheet 32 connected to the D-shaped frame structures 34, the netting sheet 32 conforms to the shape of the frame structures 34. The netting sheet 32 is sufficiently flexible to take on the shape of the frame structures 34, thereby forming the three-dimensional tubular shape of the device 30. The semicircular portion 60 of the frame structure 34 causes the netting sheet 32 to have a shape similar to a half cylinder at the top of the device 30. The half-cylindrically shaped top of the device 30 is spaced from the ground 36 by the length of each leg portion 56 and 58. The netting sheet 32 extends downward from the semicircular portion 60 of the D frame structures 32 along the length of the leg portions 56 and 58 and terminates at the lower end of the leg portions 56 and 58 adjacent to the ground 36. The netting sheet 32 need not terminate immediately adjacent to the ground 36, but may be spaced at a distance above the ground. Spacing the lower end of the netting sheet 32 a slight distance above the ground does not diminish the effectiveness of the device 30 in controlling windblown particles, because the wind velocity near the ground is reduced naturally. The netting sheet 32 also extends longitudinally along and between each of the spaced apart D-shaped frame structures 34. The netting sheet 32 also extends slightly longitudinally beyond the outermost ones of the frame structures 34, thereby establishing open ends of the device 30 at opposite longitudinal ends.

The radius of curvature of the semicircular portion 60 and the length of each leg portion 56 and 58 between the base portion 54 and their transitions to the semicircular portion 60 establishes the overall height of the device 30 from the ground 36. The overall height of the device 30 is established in consideration of the strength of the wind, typical depth of the snowcover, the height of the natural vegetation, and in the case of controlling windblown particles, the estimated mass flux of transported material that must be deposited in the particular locale where the device 30 is used. Typically, the device 30 has an overall height of two to four feet when secured to the ground 36, and a length of four to fifty feet.

The straight base portion 54 of the frame structures 34 helps to stabilize the device 30 against wind forces by its contact with the ground 36 to resist any tendency of the device 30 to tip or roll under the influence of wind loads. The half-cylinder upper shape of the device 30 also helps to reduce deformation from wind loads and particle accumulation by transmitting the force to the vertical leg portions 56 and 58 and to the ground 36.

The frame structures 34 are each preferably made from galvanized steel wire to impart enough structural strength to support the netting sheet 32 and to withstand the forces created by blowing wind and the weight of accumulated snow. A single length of such wire may be used to form each frame structure 34 as an integral unit. A single length of wire is formed into the shape of the frame structure 34 and its free ends are thereafter welded or coupled together to form an integral endless configuration of the frame structure 34. Other materials, such as solid plastic or plastic tubing, may also be used for constructing the frame structures 34 provided that they possess the necessary strength characteristics to support the netting sheet 32 without substantial deformation.

Although the base portions 54 of the frame structures 34 contact the ground 36 and help support the device 30, it is the anchor system that provides the primary attachment of the device 30 to the ground 36. The anchor system also permits the frame structures 34 to resist wind loads by securing the frame structures 34 to the ground 36.

The anchor system includes the anchor loops 40 which are formed as part of the frame structures 34 at the corners where the base portion 54 intersects the leg portions 56 and 58, as shown in FIGS. 1–3. The anchor loops 40 are preferably formed by twisting an overlapping anchor loop 40 into the frame structure 34 at the junction of each leg portion 56 or 58 with the base portion 54. Separate rings to form the anchor loops 40 could be welded to the corner intersection of each leg portion 56 or 58 with the base portion 54, but forming the anchor loops 40 by an overlapped twisted portion of the same wire which forms the frame structure 34 is more convenient and less expensive.

The frame spikes 38 are driven through the anchor of loops 40 to secure the frame structure 34 to the ground 36. Each frame spike 38 is preferably formed with a galvanized steel shaft attached to a head. The head is larger across than an anchor loop 40, so each head contacts the anchor loop but does not pass through the anchor loop. Each spike 38 is therefore nail-shaped, with a shaft diameter of about 0.20 inches and a length of about 8–12 inches, depending on soil characteristics. The head can be a circular shape, or the head may assume another shape so long as it has sufficient size to contact and hold the anchor loop 40 to the ground 36. The frame spike 38 can also assume the shape of a staple or other conventional shape for attaching an object to the ground 36.

The primary function of anchoring the device 30 to the ground 36 is achieved by extending the frame spikes 38 through the anchor loops 40 and into the ground 36. The longitudinal restraint cable or wire 42 provides secondary or additional restraint that the device 30 will not be blown away or moved substantially away from its initial position in the event the frame spikes 38 anchoring the individual frame structures come loose or are dislodged from the ground 36.

As shown in FIG. 1, the restraint wire 42 is connected to the frame structures 34 by extension through the anchor loops 40, before driving the spikes 38 through the anchor loops 40 and into the ground. Alternatively, the restraint wire 42 can extend within an open center within each D-shaped frame structure 34 above the base portion 54. As an alternative to threading the restraint wire 42 through the anchor loops 40 or extending the restraint wire 42 through the open center of the frame structure 44, the restraint wire 42 may also be connected to the frame structures 34 with the same type of hog-ring connector used to attach the netting sheet 32 to the frame structures 34. A single longitudinal restraint wire 42 can be used to anchor multiple devices 30 aligned in a row, if multiple devices 30 are connected together in an end-to end relationship, or the single longitudinal restraint wire 42 can be used to anchor a single relatively long control device 30.

The restraint wire 42 is connected to the ground 36 by driving the restraint spikes 46 through the restraint loops 44 at the ends of the restraint wire 42. The restraint wire 42 can also be connected to the ground 36 at positions between the restraint loops 44 at its terminal ends, by connecting a connector (not shown) to the restraint wire 42 at an intermediate position between the opposite restraint loops 44, and inserting a restraint spike 46 through that connector.

Figure 4:
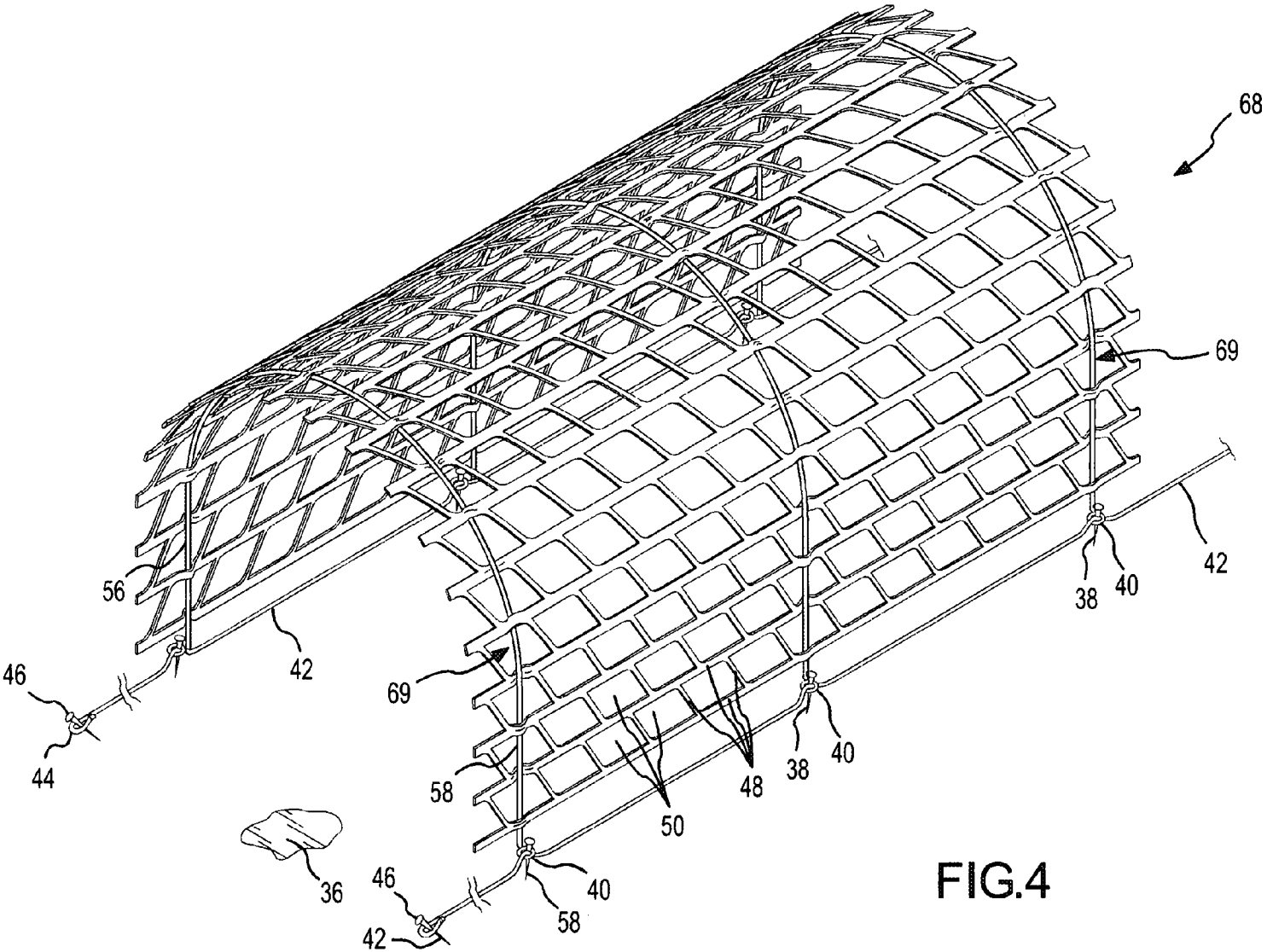
FIG. 4 is a perspective view of another porous tubular windblown particle control device which also incorporates the present invention.

Another porous tubular windblown control device 68, which also incorporates the present invention, is shown in FIG. 4. The control device 68 uses frame structures 69 generally having an outer peripheral shape of an alphabetical letter "U", rather than in a D-shaped configuration. Consequently, the base portion 54 (FIG. 1) is eliminated from each frame structure 69. The anchor loops 40 are formed by twisting and overlapping an end portion of the leg portions 56 and 58 of the U-shaped frame structure 69. Connecting the anchor loops 40 to the ground 36 by the frame spikes 38 establishes adequate transverse support between the opposite leg portions 56 and 58 for the U-shaped frame structures 69, without the base portion 54 of the D-shaped frame structures 34 (FIG. 1), because the retention of the anchor loops 40 to the ground 36 establishes almost as much structural integrity for the U-shaped frame structure 69 as the base portion 54 establishes for the D-shaped frame structures 34. Connecting the U-shaped frame structures 69 to the ground also establishes the tubular configuration and also establishes an open center through the U-shaped frame structures.

The porous tubular windblown control device 68 with the U-shaped frame structure 69 is used in essentially the same described manner as the control device 30 with the D-shaped frame structure (FIG. 1), and the control device 68 performs in essentially the same manner as the control device 30. However, the advantage of the control device 68 is that it may be preassembled away from the site of its use and shipped economically to the use location in assembled form. Multiple control devices 68 using U-shaped frame structures 69 can be stacked or nested on top of one another and shipped without consuming excessive space. The open bottom of the control devices 68 allows the U-shaped frame structures 69 to be stacked on top of one another with the rounded half-cylinder top portion of the lower control device 68 receiving the U-shaped frame structures 69 of the upper control device 68. Nesting the preassembled control devices 68 in this manner makes it economical to ship them in preassembled form, because each control device does not consume excessive space. Similarly, control devices 68 with U-shaped frame structures 69 can also be stored during time periods when they are not used by stacking the assembled devices in the same manner. It is not necessary to disassemble the control devices 68 to obtain the advantage of compact and space-efficient storage.

The invention described in the U.S. patent application identified above illustrates the orientation of a relatively small sheet 32 of netting material 33 extending transversely across each porous tubular control device. Extending the small sheet 32 of netting material 33 transversely across a singular windblown particle control device has the effect of limiting the overall length of each control device to the width of the sheet 32 of netting material. The relatively shorter length of the resulting control device requires multiple separate control devices to be positioned in an end-to-end relationship in order to obtain the typical length required for effective windblown particle control. Fabricating multiple control devices, and retaining them in an end-to-end relationship to obtain the desired effective length increases the amount of the constituent components required to fabricate a windblown particle control device having a desired length greater than the length of the single control device. Additional labor and time is also consumed in constructing multiple control devices and then retaining them in the end-to end relationship.

A single, considerably-longer, porous tubular windblown particle control device 30 (FIGS. 1–3) or 68 (FIG. 4) may be fabricated from single longer sheet 32 of the netting material 33 which is oriented to extend longitudinally rather than transversely. A single, longitudinally extending sheet 32 of netting material 33 used to fabricate the control devices 30 are 68 is shown in FIG. 2. The netting material 33 is typically supplied in relatively long lengths, with the webs 48 being generally aligned with one another in the longitudinal direction. The webs 48 which extend transversely to the length of the long sheet 32 are not generally aligned with one another as consistently as are the webs 48 which extend longitudinally, thereby distinguishing the longitudinal characteristic of the sheet from the transverse characteristic. FIGS. 1 and 4 illustrate the longitudinal orientation of the netting sheets 32 attached to the frame structures 34 and 39, respectively. By extending a single longer sheet 32 of netting material 33 to substantially the full length desired for a single control device, or the length for convenient fabrication, as shown in FIG. 3, it becomes unnecessary to connect or otherwise link together a multiplicity of relatively shorter individual control devices to obtain the desired effective windblown particle control length. For example, the length of each longer sheet 32 may extend to approximately 50 feet, compared to a typical maximum length of approximately 4–8 feet resulting from transversely orienting the sheets 32 of netting material 33 on the control device. Utilizing a single longer sheet oriented longitudinally with respect to the control device 30 also facilitates and simplifies the fabrication of the single larger control device 30, because less effort and constituent materials are required to fabricate the single longer device 30 compared to fabricating a multiplicity of relatively shorter control devices and then linking them together end-to-end. The longer particle control devices can also be connected in an end-to-end relationship, but the number of such connections and the effort required to connect and restrain the longer control devices is diminished.

A single longer windblown particle control device 30 with the longitudinal orientation of the netting sheet 32, shown in FIG. 3, is preferably fabricated in a manner which can be understood by reference to FIG. 2. The D-shaped frame structures 34 are laid out on the ground 36 in the position where the single longer control device 30 will be located. At least one longitudinal restraint wire 42 is connected to the frame structures 34, either by extending the wire 42 through the anchor loops 40 of some or all of the frame structures 34, as shown in FIG. 2, or by extending the wire 42 through the center of each of the D-shaped frame structures 34 (not shown). Frame spikes 38 are driven through the anchor loops 40 to erect the frame structures 34 and orient them vertically from the ground, as shown in FIG. 2. Thereafter, the single relatively long sheet 32 of netting material 33 is draped over and connected to the linear array of D-shaped frame structures 34 by the use of the netting connectors 52.

A single longer windblown particle control device 68 with the longitudinal orientation of the netting sheet 32, shown in FIG. 4, may be constructed in essentially the same manner as is illustrated in FIGS. 2 and 3. In the case of the control device 68, the U-shaped frame structures 69 are laid out on the ground in a linear array. The restraint wire 42 is extended through some or all of the anchor loops 40 of the U-shaped frame structures 69, and frame spikes 38 are driven through the anchor loops 40 to erect the frame structures 69 and orient them vertically from the ground. Thereafter, the single relatively long sheet of netting material is draped over the linear array of U-shaped frame structures 69 and is connected to the frame structures by the use of netting connectors 52.

It is also possible to connect the single longer windblown particle device with the longitudinal orientation of the netting sheet 32 by connecting the netting sheet to the frame structures 34 or 69 before attaching the frame structures to the ground. In general, attaching the frame structures to the netting sheet before attaching the frame structures to the ground may be somewhat awkward because the netting sheet and frame structure components of the control device can exhibit relative movement with respect to one another and there is no significant restraint of either component to help assist in locating and connecting the other component.

On the other hand, connecting the U-shaped frame structures 69 to the netting sheet 32 before connecting the frame structures 69 to the ground can offer the advantage of eliminating the use of netting connectors 52, as shown in FIG. 4. The U-shaped frame structures 69 are woven through a line of apertures 50 extending transversely across the netting sheet 32. An end of each U-shaped frame structure 69 at one of the anchor loops 40 is threaded through the transverse line of apertures 50, with adjacent webs 48 positioned on opposite sides of the frame structure 69. Weaving the frame structure 69 through the transverse line of apertures 50 in this manner is possible because the end of each frame structure 69 terminates at the anchor loop 40 and because the relative flexibility of the netting sheet 32 permits weaving a free end of each frame structure through the apertures. Weaving the frame structures 69 through a transverse line of apertures 50 in the netting sheet 32 in this manner cannot be accomplished if the anchor loops 40 at both ends of the frame structures are connected to the ground, or if the frame structure does not have a free end, which is the case with the D-shaped frame structures 34 (FIGS. 1 and 2). Those frame structures with closed configurations cannot be woven through the apertures 50 in the netting sheet 32, because there is no free end of those frame structures to thread through the apertures 50. It is possible to close the configuration of the frame structure after it has been woven through the transverse line of apertures, such as by connecting a separate base portion 54 (FIG. 1) to a U-shaped frame structure 68 (FIG. 4).

Each of the U-shaped frame structures 69 is formed from a length of galvanized steel wire which has been permanently bent into a U-shaped configuration, with the anchor loops 40 twisted on the ends of the wire. Each U-shaped frame structure may also be formed from a length of resilient straight spring wire which is then bent into the U-shaped configuration as a result of attaching its free ends to the ground to hold the wire in the U-shape, as may be understood from FIGS. 5–10.

Figure 5:
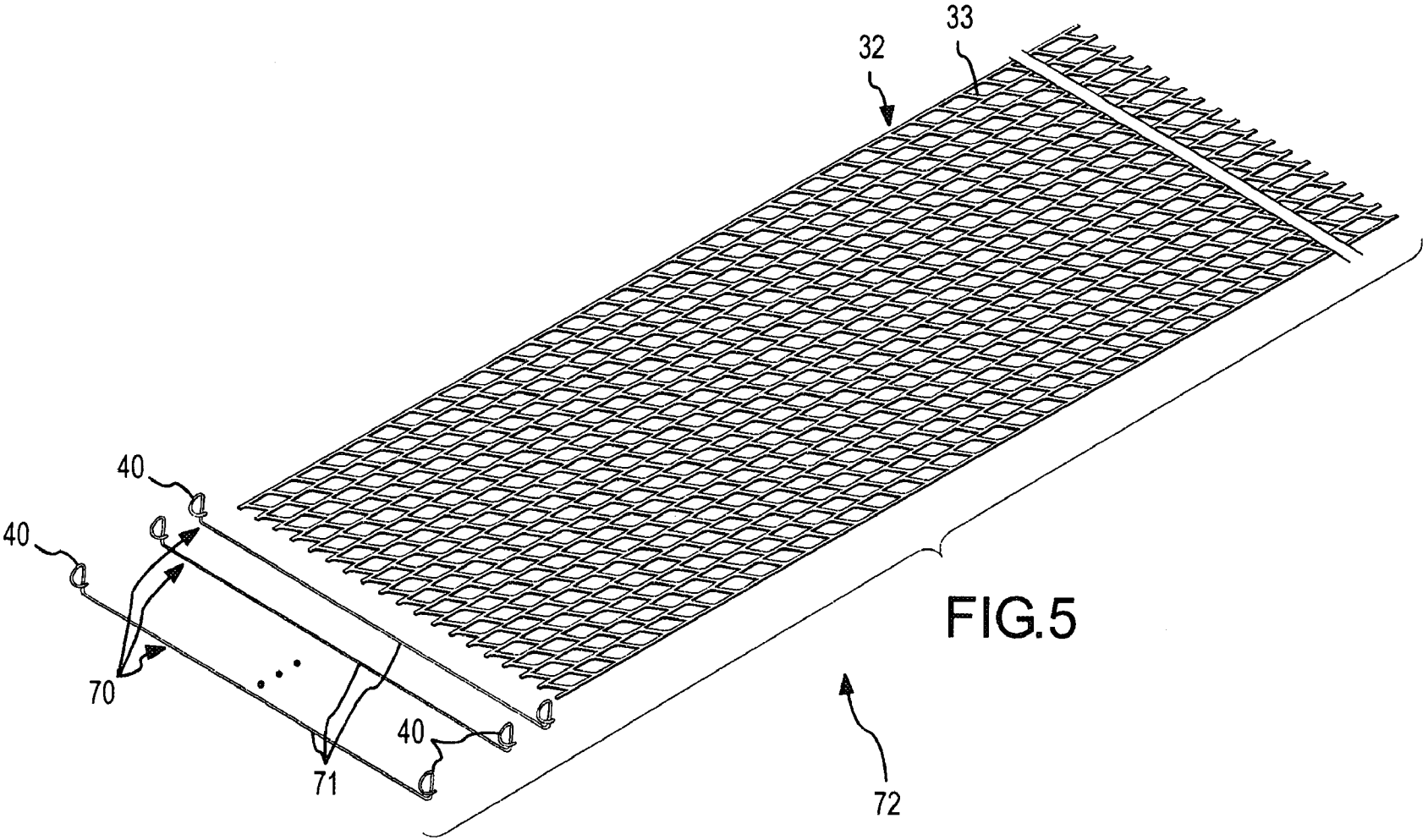
FIG. 5 is a perspective view of a plurality of bendable straight frame structures and a sheet of netting or mesh material, which constitute the basic constituent components used to fabricate the control device shown in FIG. 4.
Figure 6:
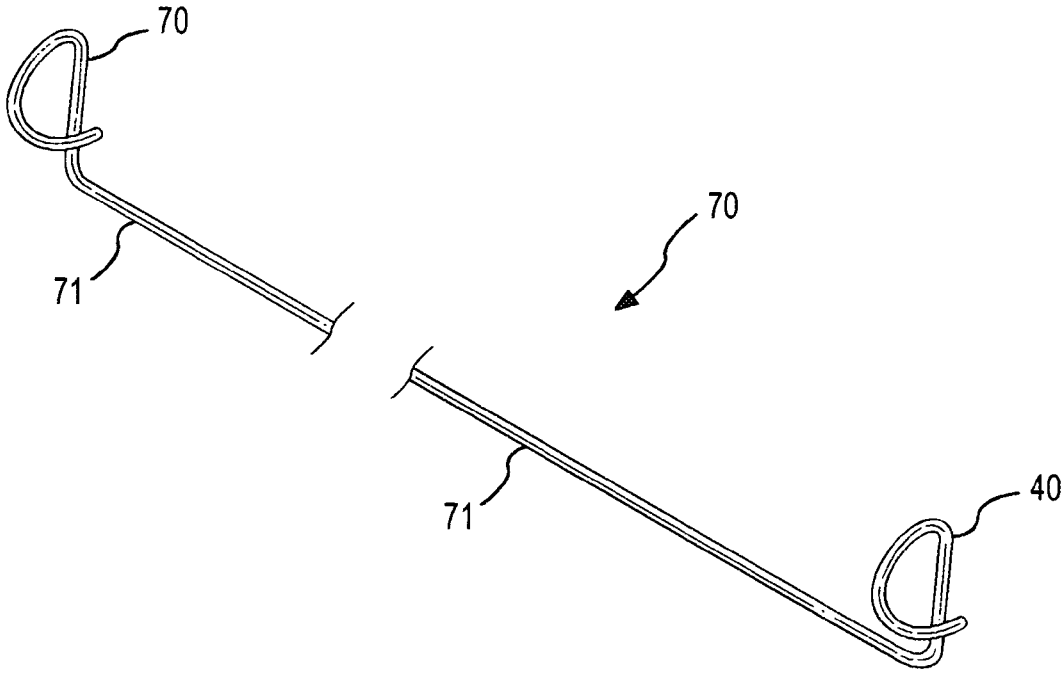
FIG. 6 is an enlarged perspective view of one of the bendable straight frame structures shown in FIG. 5.
Figure 7:
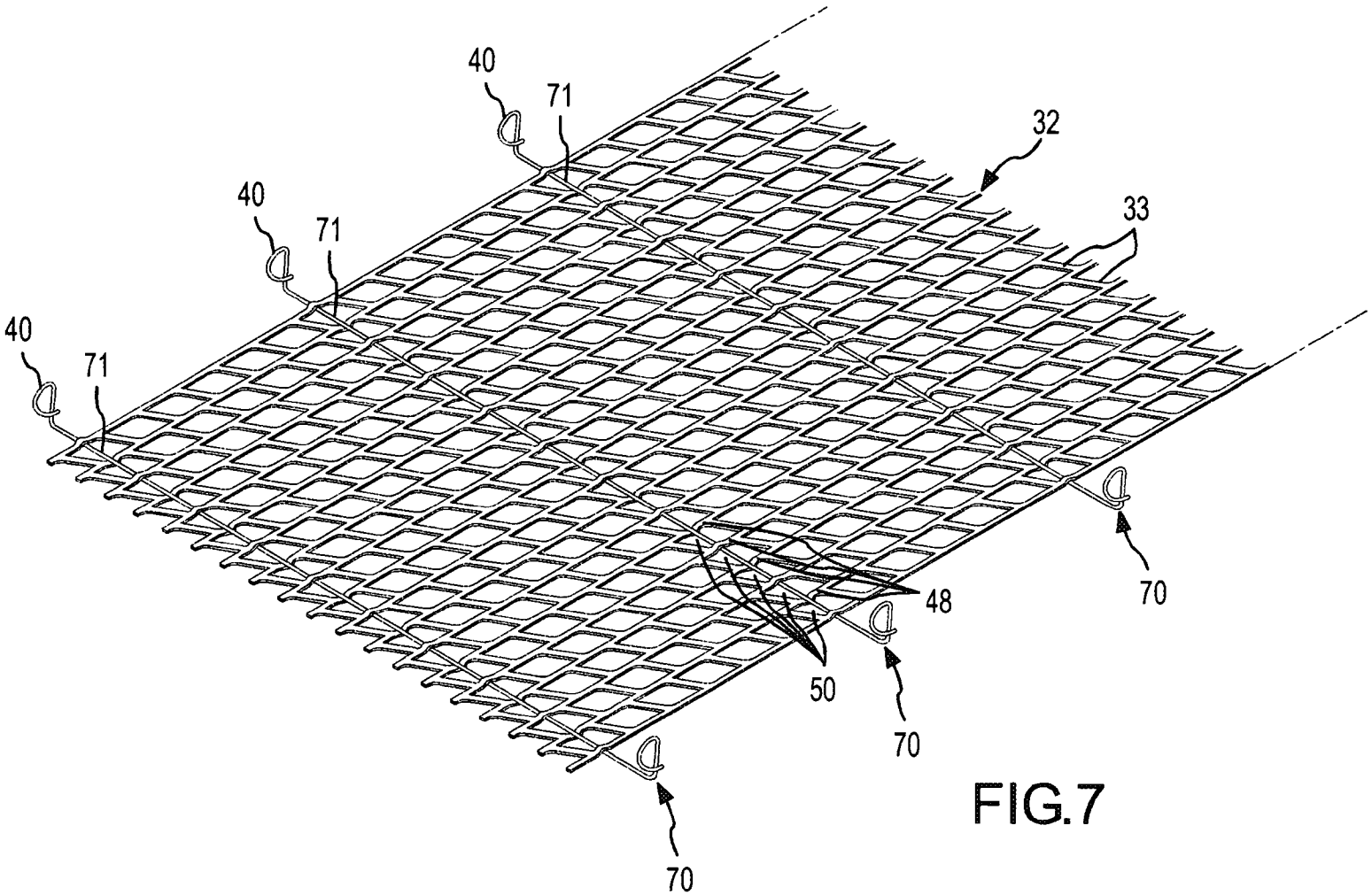
FIG. 7 is a perspective view of the interconnection of the frame structures and the netting sheet components shown in FIG. 5, before the control device is erected.
Figure 8:
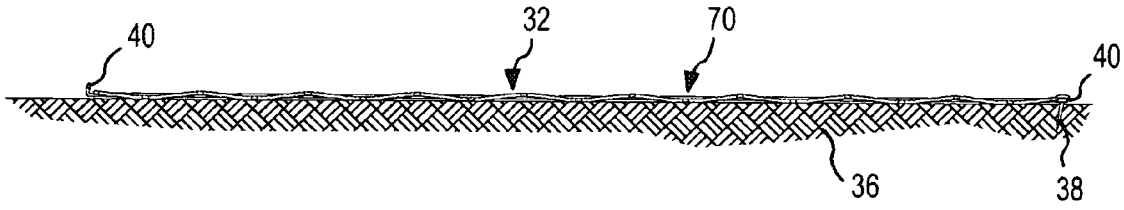
FIGS. 8–10 are end elevational views of the interconnected frame structures and netting sheet shown in FIG. 7, illustrating a sequence of actions required to erect the control device shown in FIG. 4 from the interconnected constituent components of the control device shown in FIG. 7.
Figure 9:
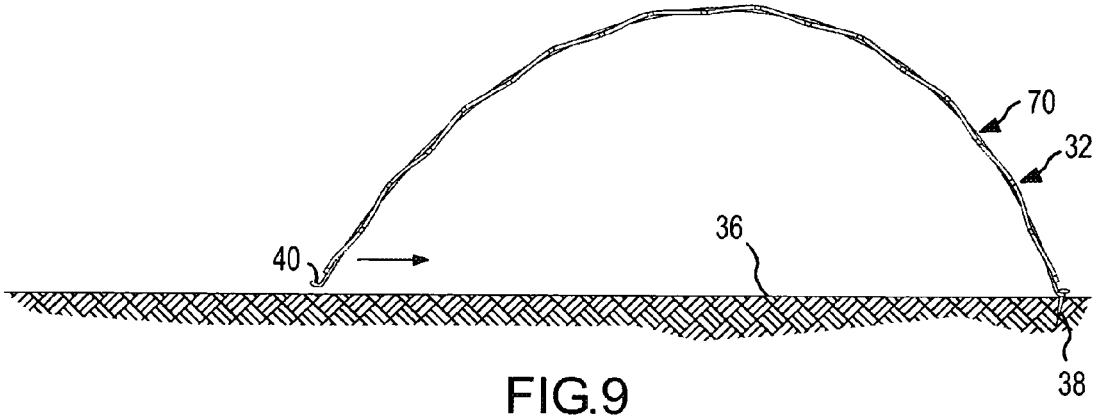
Figure 10:
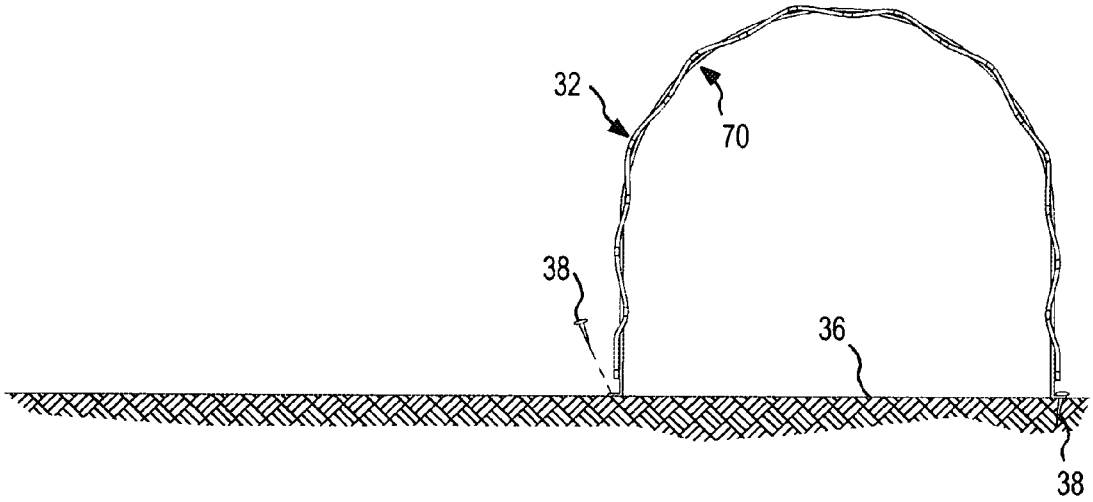

A straight frame structure 70, which may be bent into a U-shaped frame structure, is formed from a length of resilient bendable spring wire 71, as shown in FIGS. 5 and 6. Anchor loops 40 are formed at the opposite ends of the wire 71 by twisting and overlapping an end portion of the wire into the anchor loops 40. The anchor loops 40 may be oriented perpendicularly with respect to the longitudinal extent of the main body of the wire 71, as shown in FIG. 6. Alternatively, separate rings to form the anchor loops 40 could be welded to the ends of the wire 71. The straight frame structures 70 are woven through a transverse line of apertures 50 in the netting sheet 32, by passing the frame structure 70 alternately above and below the webs 48 which help define the transverse line of apertures 50 extending across the netting sheet 32, as shown in FIG. 7. Thereafter, the straight frame structures 70 and the attached netting sheet 32 are bent into and held in the U-shaped configuration by attaching the anchor loops 40 to the ground with the spikes 38, as is shown in FIGS. 8–10.

The resilient spring wires 71 of the bent straight frame structures 70 must have sufficient rigidity to support the entire weight of the netting sheet 32 and any snow or other particles that may accumulate on top of the control device 68, and to withstand the lateral wind loading forces applied to the particle control device during use, without sagging substantially. For these reasons, the wire 71 from which the straight frame structures 70 are preferably made is galvanized, spring steel wire that provides sufficient rigidity because of its diameter to sustain the weight and load factors. Of course, if a non-spring steel wire has sufficient strength and rigidity characteristics while still being bendable, or if other types of metallic and nonmetallic materials exhibit sufficient strength and rigidity while still being bendable, they may also be used to form the straight frame structures 70.

An entire porous tubular windblown particle control device may be fabricated quickly and economically from one sheet 32 of netting material 33 and a plurality of straight frame structures 70, shown in FIG. 5. The netting sheet 32 and the plurality of the bendable straight frame structures 70 shown in FIG. 5 constitute an assemblage or a kit 72 of the constituent components for fabricating the porous tubular windblown particle control device. Although not shown in FIG. 5, the kit 72 may also include a plurality of frame spikes 38 and one or two longitudinal restraint wires 42 (FIG. 1).

To assemble a windblown particle control device from the kit 72, the netting sheet 32 is secured to the bendable straight frame structure 70 by weaving the straight frame structures 70 through a transverse line of apertures 50 in the netting sheet 32. The straight frame structures 70 are woven through transverse lines of apertures in the netting sheet at longitudinally spaced intervals along the length of the netting sheet 32. The interval distance between the straight frame structures 70 is established to provide adequate support for the netting sheet 32 when the control device is erected by connecting the ends of the straight frame structures 70 to the ground. The straight frame structures extend on alternating sides of the longitudinally-extending webs 48 (as shown in FIGS. 4 and 7). The transverse line of apertures through which the straight frame structures 70 are woven preferably extends perpendicular to the length dimension of the netting sheet 32. Weaving the bendable straight frame structures 70 into the netting sheet 32 in this manner firmly connects each bendable straight frame structure 70 to the netting sheet 32 without the need for a separate netting connector (e.g. 52, FIG. 1). Alternatively considered, the woven relationship of the straight frame structures 70 within the apertures 50 and webs 48 of the netting sheet 32 forms interactive netting connectors rather than separate netting connectors 52 (FIG. 1). Weaving the wires of the bendable straight frame structure 70 through the apertures 50 in this manner also eliminates the expense and time required to use separate netting connectors 52 (FIG. 1), virtually eliminates the possibility of the netting sheet 32 separating from the frame structures due to failures of the separate netting connectors, and allows quick and convenient disassembly of the control device 80, among other advantages.

Once the straight frame structure 70 have been woven into the transverse line of apertures 50 across the netting sheet 32, as shown in FIG. 7, the erection of porous tubular windblown particle control device begins as shown in FIG. 8, by driving spikes 38 into the ground 36 through the anchor loops 40 which extend along one longitudinal side of the longitudinally-extending netting sheet 32. Preferably, the longitudinal restraint wire has already been extended through these anchor loops 40, although the longitudinal restraint wire is not shown in FIGS. 8–10. Once these ends of all of the straight frame structures 70 have been permanently anchored to the ground 36 with the spikes 38, the other opposite of free ends of each bendable straight frame structure 70 are moved toward the anchored ends, as shown in FIG. 9. As the free end moves toward the permanently anchored ends, the middle portion of each straight frame structure 70 arches away from the ground 36, as shown in FIG. 9. Movement of the free end toward the anchored end continues in this manner until the desired final U-shape and curvature has been achieved, as shown in FIG. 10. Once the straight frame structures 70 have been bent into the desired curvature, a second spike 38 is driven through the anchor loops 40 to permanently secure the other, previously-free ends of the frame structure 70 to the ground 36.

As the free ends of the straight frame structures 70 are moved through the intermediate positions toward the permanently anchored end, as illustrated in FIG. 9, it may be necessary to temporarily anchor the free ends to the ground 36 to hold the intermediate level of the arched curvature, allowing all of the free ends to be moved in uniform movement intervals or stages toward the anchored end. Each of the temporarily anchored free ends of the frame structures 70 is disconnected from the ground 36, one at a time, and moved closer toward the permanently anchored end of the frame structures 70 and then again temporarily anchored until all of the frame structures 70 have achieved approximately the same degree of arched curvature. In this manner, the middle portions of all of the straight frame structures 70 experience comparable amounts of curvature during the intermediate stages of erecting the control device, as the free end of each straight frame structure 70 is moved toward the permanently anchored end. This process continues until the free ends of the frame structures 70 have been moved to the final position where the desired degree of curvature is achieved, as shown in FIG. 10. Once in the final position, the free end of each straight frame structure 70 is permanently connected to the ground 36 by driving a spike 38 through the anchor loop 40. Moving all of the frame structures 70 and the entire interconnected netting sheet 32 in stages to gradually achieve the desired amount of final curvature assures that no single one of the bendable straight frame structures 70 will be overstressed and permanently deformed as a result of bending it to such a degree that it must support considerably more of the weight of the entire netting sheet 32 than would otherwise be the case when all of the frame structures 70 have approximately similar curvatures.

Fabrication and erection of the entire windblown particle control device from the kit 72 of the netting sheet 32 and the straight frame structures 70 is quickly and efficiently accomplished, in the manner described. The straight frame structures 70 and the netting sheet 32 are not heavy or bulky materials which are difficult to transport, carry to the site of use, and manipulate when interconnecting the frame structures 70 with the netting sheet 32 and arching the interconnected frame structures and netting sheet into the final curvature of the porous tubular windblown particle control device. Consequently, windblown particle control devices can be erected more quickly with a lesser number of personnel and at reduced expense.

Just as the entire windblown particle control device can be erected in a relatively quick and efficient manner, it can be taken down in a similarly quick and efficient manner. The spikes 38 are removed along one longitudinal edge of the interconnected netting sheet 32 and straight frame structures 70, and the free ends of the frame structures are moved away from the anchored ends in stages in a process which is essentially the reverse of the process used to erect the control device. Movement of the free ends of the frame structures 70 continues in this manner until the interconnected netting sheet 32 and frame structures 70 lay flat on the ground as shown in FIG. 8. Because the wires 71 (FIG. 6) used to form the bendable straight frame structures 70 are resilient spring wires, the frame structures 70 straighten out between the anchor loops 40 when the control device is taken down, as shown in FIGS. 7 and 8.

After taking down the control device in this manner, the position of the control device may be relatively easily shifted or adjusted by moving the netting sheet 32 and interconnected frame structures 70 to a new desired position. Thereafter, the netting sheet 32 and interconnected frame structures 70 are again erected relatively quickly and efficiently to locate the porous tubular windblown particle control device in a better position to obtain the optimal windblown particle control effects.

Figure 11:
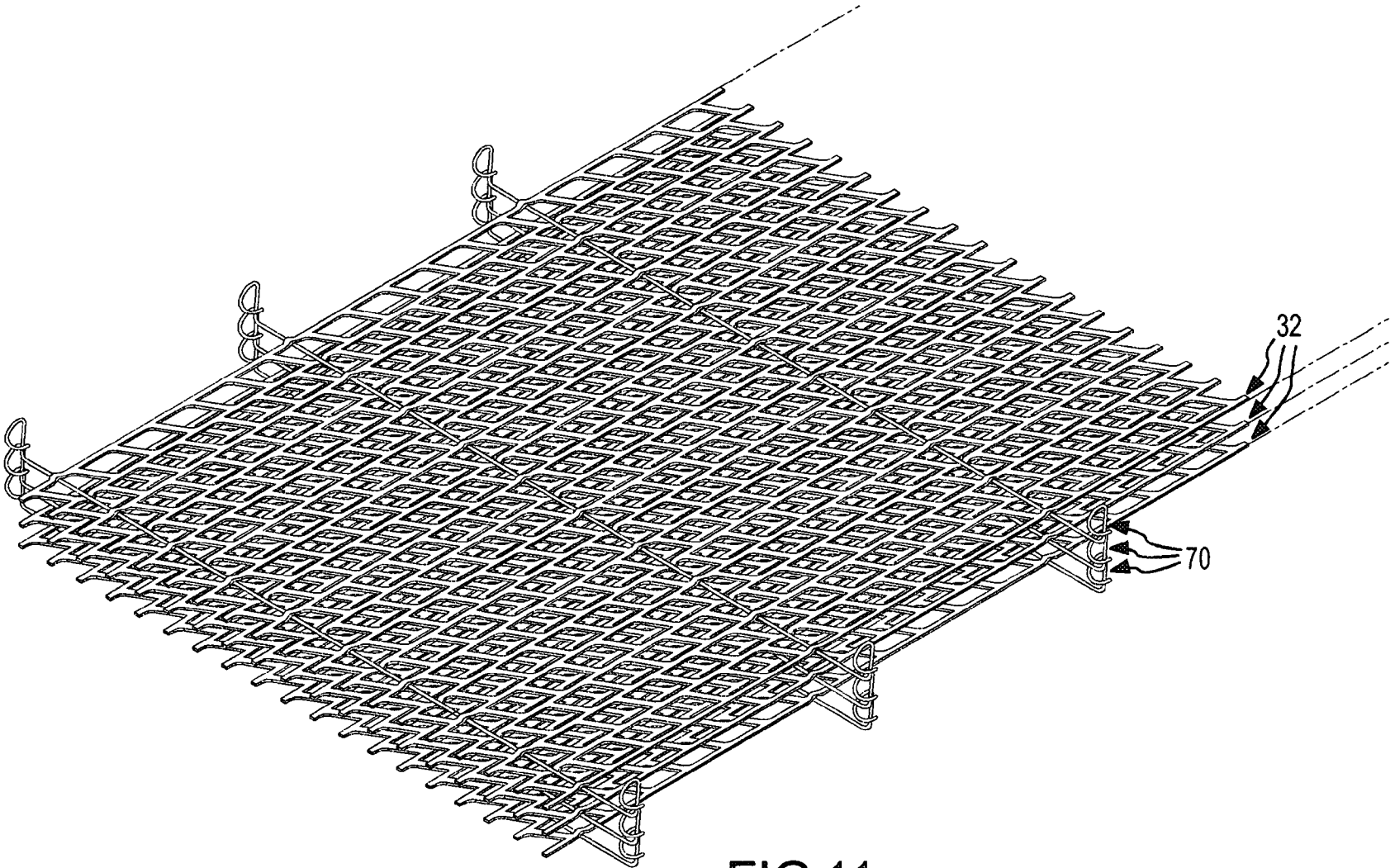
FIG. 11 is a perspective view of a plurality of interconnected frame structures and netting sheets of the type shown in FIG. 7, shown stacked on top of one another.

If it is desired to remove the windblown particle control device from the site of its use during those parts of the year when it is not needed, each netting sheet 32 and its interconnected frame structures 70 is taken down in the manner described and then can be stacked on top of another netting sheet 32 and its interconnected frame structures 70, as shown in FIG. 11. Stacking the netting sheets 32 and interconnected frame structures 70 in this manner is a highly efficient use of space, because of the relative thinness of each netting sheet and its interconnected frame structures. Little space is wasted by laying each netting sheet with its interconnected frame structures on top of one another. Stacks of netting sheets 32 with their interconnected frame structures 70 may be accumulated at the site of use, and thereafter transported to a storage location or stored at the site of use.

Figure 12:
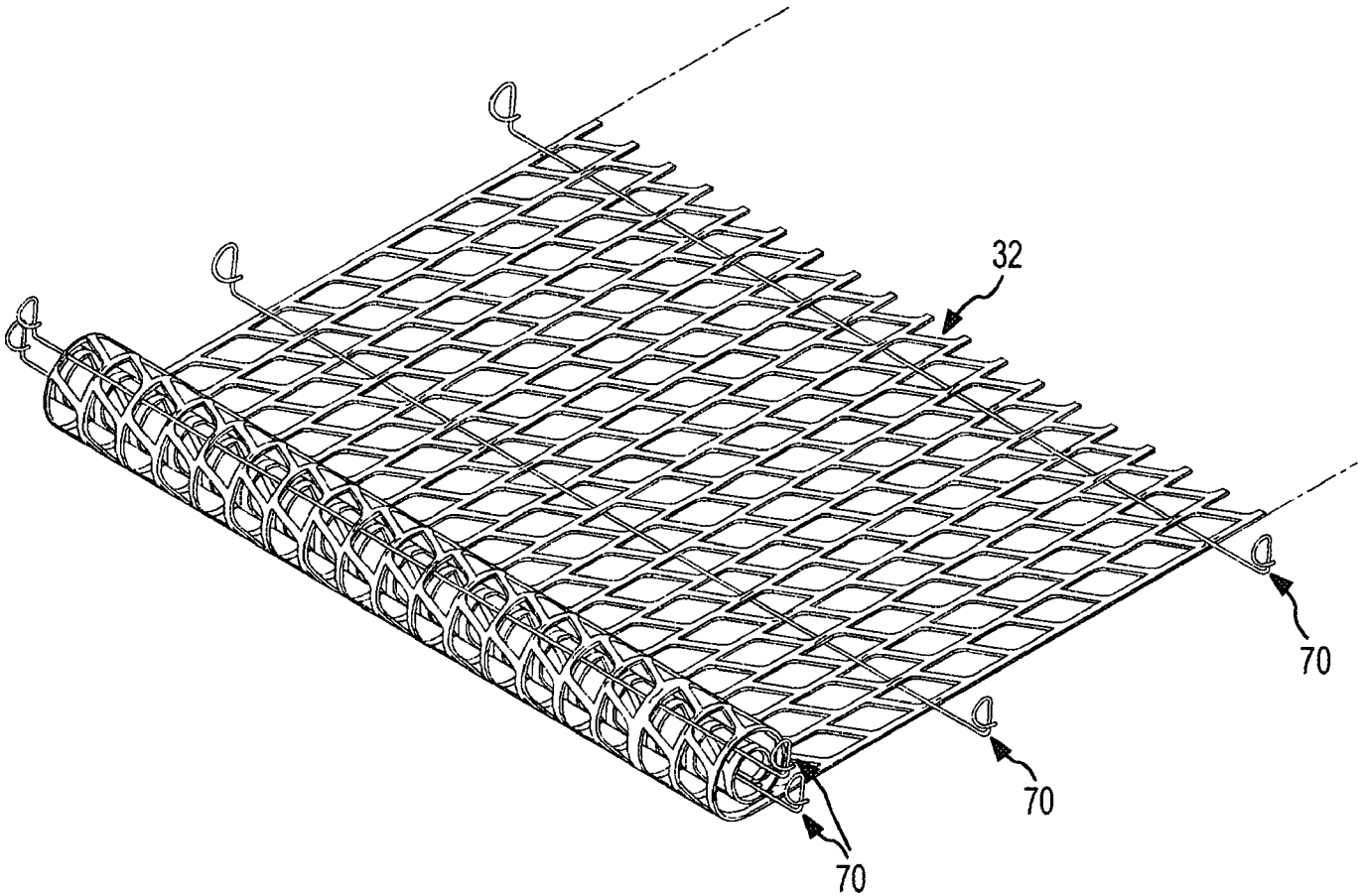
FIG. 12 is a perspective view illustrating the formation of a roll from a single netting sheet with interconnected frame structures of the type shown in FIG. 7.

Because of the relative flexibility of the netting sheet 32 and because the frame structures 70 extend generally parallel to one another transversely across the length of the netting sheet 32, it is also possible to roll each netting sheet 32 with its interconnected frame structures 70 into a roll, as illustrated in FIG. 12. Because the frame structures 70 extend transversely across the length of the netting sheet 32, rolling the netting sheet 32 with its interconnected frame structures 70 is not inhibited by the frame structures 70 since they extend parallel to the axis of the roll. Rolling the netting sheet 32 with its interconnected frame structures 70 is also an efficient use of space for storing the control device, because very little space is consumed and wasted by the completed roll. The completed roll is also relatively easy to transport and maneuver because of the relatively low weight of the netting sheet 32 and the frame structures 70. Completed rolls can be stacked to use the storage space efficiently, and to minimize the amount of storage space required to store the taken-down particle control devices.

If desired, the straight frame structures 70 can be removed from the netting sheet 32 before storage. However, because very little space is consumed by leaving the frame structures 70 interwoven with the netting sheet 32, as illustrated in FIGS. 11 and 12, there is usually no important need for such disassembly. Should the netting sheet 32 deteriorate, replacement of the netting sheet 32 is easily accomplished by removing the frame structures 70 from the deteriorated netting sheet and weaving the removed the frame structures 70 into a replacement netting sheet in the manner described. Replacing deformed or broken frame structures 70 is also easily accomplished. Consequently, servicing the control device is relatively convenient and efficient.

Figure 14:
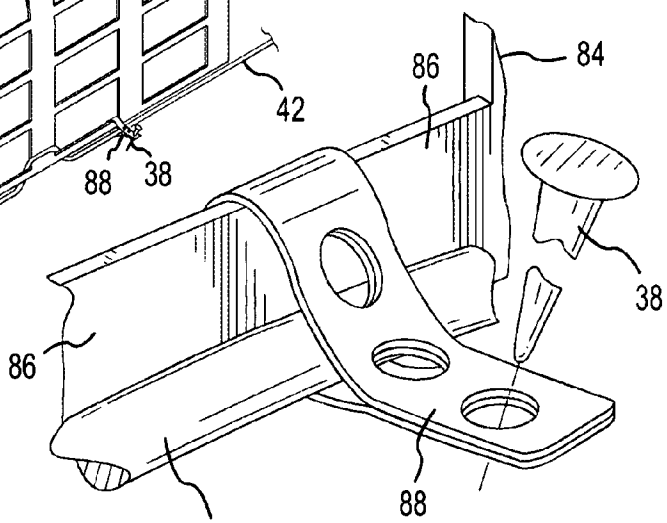
FIG. 14 is an enlarged perspective view of a portion of FIG. 13.
Figure 13:
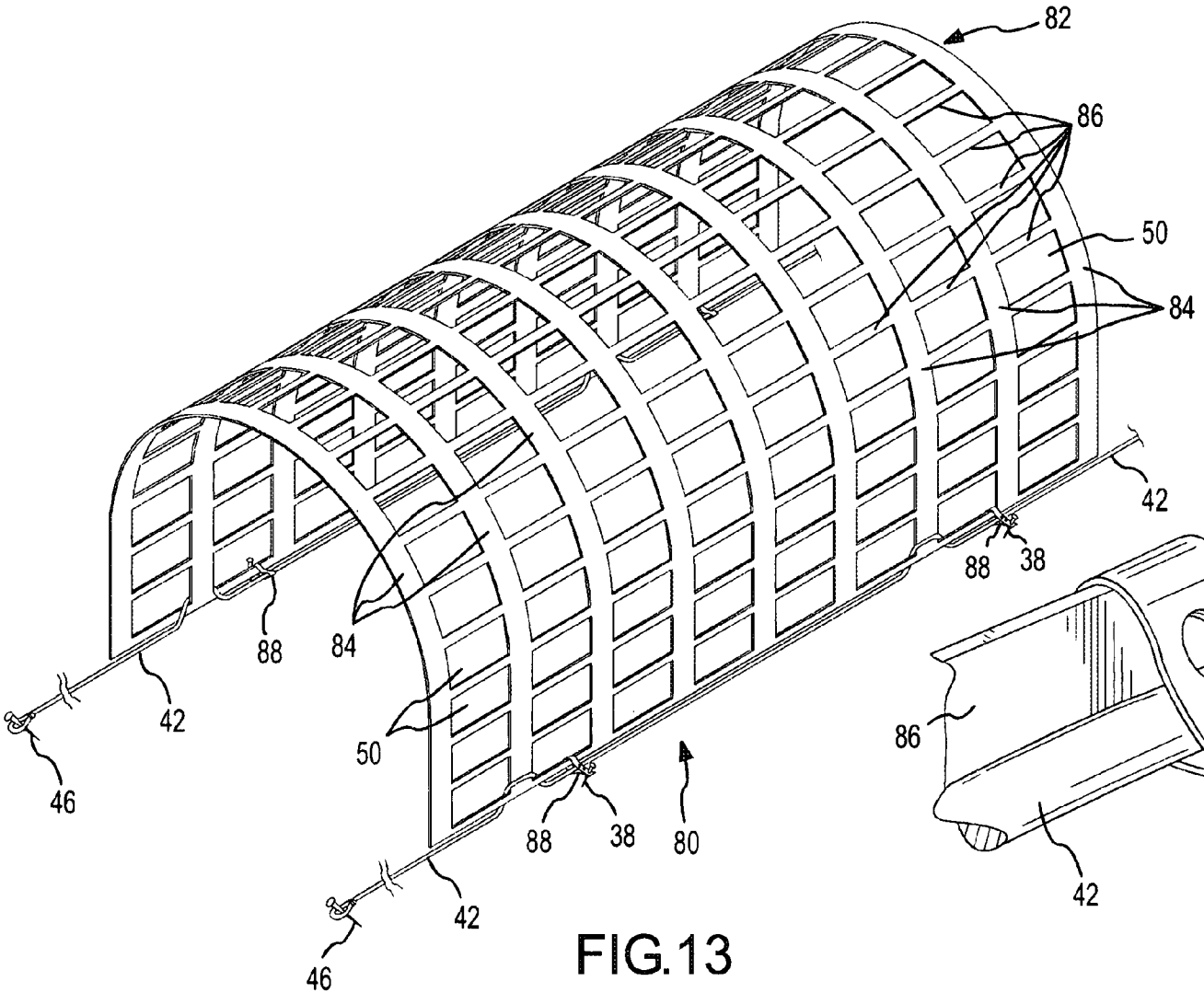
FIG. 13 is a perspective view of another porous tubular windblown particle control device which also incorporates the present invention.

A porous tubular windblown particle control device 80, which does not utilize separate frame structures, but instead utilizes an integral self-supporting capability available from its netting sheet 82, is shown and described in conjunction with FIGS. 13 and 14. The netting sheet 82 of the control device 80 is preferably a sheet of conventional geotextile or geogrid material. Conventional geotextile or geogrid material includes a spaced-apart series of parallel main support ribs 84 of relatively substantial strength and a level of rigidity which permits gentle bending of the main support ribs 84 through an arc. Extending perpendicularly from the support ribs 84 are a plurality of stringers 86 which are of less strength than the support ribs 84. The support ribs 84 and the stringers 86 constitute webs of the netting sheet 82, and the support ribs 84 and stringers 86 circumscribe and define the apertures 50 through the geotextile or geogrid material. The apertures 50 in the geotextile or geogrid material are substantially uniform in size relative to one another. In the control device 80, the support ribs 84 extend vertically relative to the ground and extend transversely across the control device 80. The stringers 86 extend horizontally parallel to the ground and longitudinally along the control device 80.

The webs and the apertures created by the support ribs 84 and the stringers 86 create the aerodynamic effects on the windblown particles passing through and adjacent to the control device 80 to obtain the desired particle control effects. The support ribs 84 and the stringers 86 have adequate strength to reduce wind velocity and alter the turbulence. The reduction in velocity and the turbulence effects remove a significant portion of the windblown particles from the wind, and the removed particles are deposited in the protected area adjacent to the control device 80. The removed particles are retained on the ground 36 in substantially the protected area where they are deposited upwind and downwind of the control device 80, due to the reduction in wind velocity and the turbulence effects over the protected area.

The support ribs 84 have sufficient width and thickness dimensions to impart enough strength to support the entire netting sheet 82 of geotextile or geogrid material, when the support ribs are bent in a vertical plane into U-shaped arches. Extending the relatively stronger support ribs 84 in the vertical plane to create the U-shaped arches which extend transversely across the control device 80, and anchoring the opposite transverse ends of the support ribs 84 to the ground 36, impart enough support through the parallel arched support ribs 84 to self-support the entire geotextile or geogrid netting sheet 82 in the tubular configuration.

The lowermost longitudinal edges of the geotextile or geogrid netting sheet 82 are held in position in contact the ground 36 by their attachment to or contact with the longitudinal restraint wire 42. The restraint wire 42 may be woven through two adjoining apertures 50 on each side of a support rib 84 along the longitudinal edges of the netting sheet 82 which contact the ground 32, or the restraint wire 42 may be woven through a longitudinal line of apertures 50 along the longitudinal edges of the netting sheet which contact the ground 32. In addition, anchor straps 88 attach some or all of the lowermost ends of the support ribs 84 and the lowermost longitudinal stringers 86 to each restraint wire 42 at spaced-apart intervals along the length of the longitudinal edges of the netting sheet 82 which contact the ground, as also shown in FIG. 14.

The restraint wires 42 on opposite transverse sides of the control device 80 are held in position by spikes 38 which extend through the anchor straps 88 into the ground 36, as shown in FIG. 14. The anchor straps 88 are positioned at spaced apart intervals along the length of each restraint wire 42. Each anchor strap 88 also extends around a longitudinal stringer 86 at the longitudinal edge of the netting sheet 82 which contacts the ground, or around a support rib 84 (not shown), thereby restraining the netting sheet 82 in the self-supporting U-shaped arch. The ends of the support ribs 84 which are not connected by the anchor straps 88 to the restraint wire 42 are preferably positioned transversely inside of the two spaced apart restraint wires 42, to enable the restraint wires 42 to resist the outward movement of the ends of those support ribs 84. Because the restraint wires 42 are connected to the ground 36 by the spikes 38 and anchor straps 88, and because the lowermost longitudinal edges of the netting sheet 82 are also connected to or contact the restraint wires 42, the transversely-opposite and longitudinally-extending ends of the geotextile or geogrid netting sheet 82 do not separate from one another and thereby maintain the self-supporting U-shaped arch of the netting sheet 82.

Erecting the porous tubular windblown particle control device 80 from the geotextile or geogrid netting material is quickly and efficiently accomplished by attaching the opposite longitudinally extending lowermost edges of the netting sheet 82 to the restraint wires 42 in the manner described, connecting one of the longitudinally extending restraint wires 42 permanently to the ground by driving the spikes 38 through the anchor straps 88 and into the ground, driving the spikes 46 through the opposite restraint loops 44 (FIG. 1) at each end of the restraint wire 42, and then slowly moving the free longitudinal edge of the netting sheet 82 with its attached longitudinal restraint wire 42 toward the other anchored edge of the geotextile or geogrid netting sheet 82. Movement in this manner causes the support ribs 84 to begin arching vertically upward, in much the same way as has been described in conjunction with FIGS. 9 and 10. Once the desired degree of curvature of the geotextile or geogrid netting sheet 82 is achieved, the movable longitudinal restraint wire is permanently attached to the ground, thereby assuring that the geotextile or geogrid netting sheet 82 is held in the self-supporting U-shaped arch. Taking down the control device 80 is accomplished by performing the erection steps in the reverse order.

Storing the control device 80 is relatively simply accomplished. After the longitudinal restraint wires 42 are disconnected from the longitudinal edges of the netting sheet 82, the geotextile or geogrid netting sheet 82 flattens to allow the sheets 82 to be stacked on top of one another in much the same manner as has been described in conjunction with FIG. 11. Alternatively, the geotextile or geogrid netting sheets 82 may be rolled in much the same manner as has been described in conjunction with FIG. 12.

The geotextile or geogrid material used in the control device 80 shown in FIG. 13 can be interchanged for the extruded plastic netting material used in the control devices 30 and 68 shown in FIGS. 1 and 4. In such a case, the main support ribs 84 of the geotextile or geogrid netting sheet 82 will be extended longitudinally along the control device 30 or 68, because the frame structures 34 and 69 provide the transverse support for the netting sheet 82. Extending the stronger support ribs 84 longitudinally also facilitates bending the geotextile or geogrid sheet 82 transversely into the curvature established by the frame structures 34 and 69.

Figure 15:
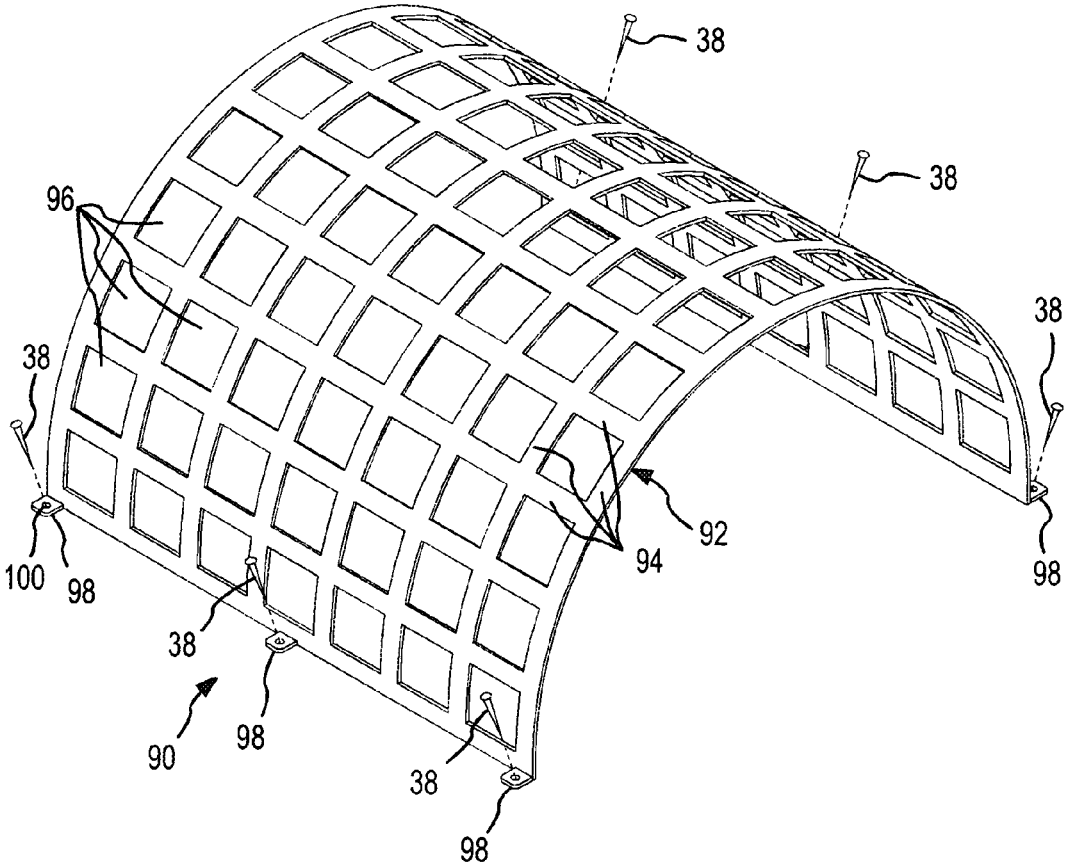
FIG. 15 is a perspective view of another porous tubular windblown particle control device which also incorporates the present invention.
Figure 16:
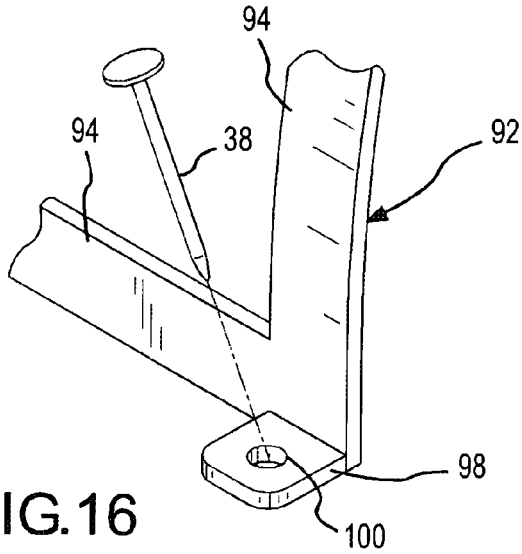
FIG. 16 is an enlarged perspective view of a portion of FIG. 15.
Figure 17:
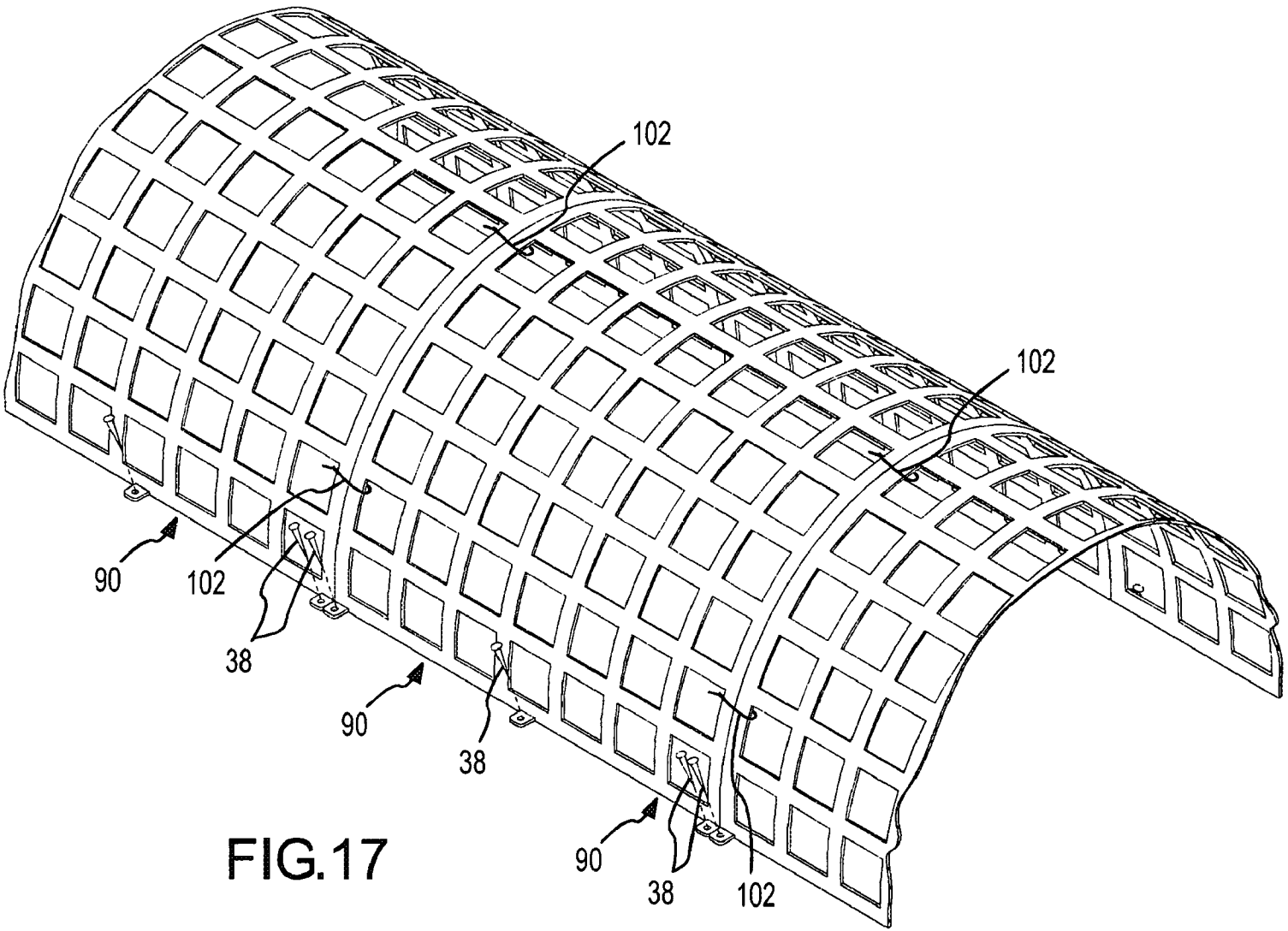
FIG. 17 is a perspective view of multiple porous tubular windblown particle control devices of the type shown in FIG. 15, shown connected together in a row.

Another porous tubular windblown particle control device 90 which does not utilize separate frame structures, is shown in FIGS. 15–17. Like the particle control device 80 which utilizes self-supporting capability of the netting sheet 82 of geogrid or geotextile material, the particle control device 90 utilizes a self-supporting capability of its netting sheet 92 to establish the shape of the control device 90. The netting sheet 92 of the control device 90 is a substantially rigid arch formed primarily from synthetic composite material, such as fiberglass. The arched netting sheet 92 is molded or laid up in the conventional manner from the composite materials, and once those composite materials cure the netting sheet 92 assumes a permanently arched configuration and has sufficient strength to support itself.

Webs 94 of the netting sheet 92 surround and define apertures 96 in the arched netting sheet 92. The apertures 96 are formed when the netting sheet 92 is molded or laid up. The webs 94 and apertures 96 will generally be of uniform size relative to one another, although nonuniform sizes may be formed into the netting sheet 92. The webs 94 and the apertures 96 reduce the wind velocity and alter the turbulence effects to remove a significant portion of the windblown particles from the wind passing through and adjacent to the control device 90. The removed particles are retained on the ground 36 in the protected area where they are deposited, thereby obtaining the desired particle control effects.

Attachment tabs 98 are also molded and formed as part of the integral structure of the arched netting sheet 92, as shown in FIG. 16. The attachment tabs 98 are positioned at spaced apart intervals along the opposite longitudinal lower edges of the arched netting sheet 92. An aperture 100 extends through each tab 98, and a spike 38 extends through each aperture 100 and into the ground to anchor the arched netting sheet 92 and the control device 90 to the ground.

Because of the attachment tabs 98 are formed integrally as a part of the substantially rigid arched netting sheet 92, anchoring the control device 90 with the spikes 38 is usually sufficient to hold the control device 90 in place without the necessity of using one or more longitudinal restraint wires 42 (FIGS. 1, 4 and 13). However, if secondary anchoring is desired, a longitudinal restraint wire 42 is woven through the lowermost apertures 50 formed in the arched netting sheet 92, in a manner similar to the woven interconnection of the restraint wire 42 with the apertures 50 of the geotextile or geogrid netting sheet 82 as shown in FIG. 13, or the restraint wires may be connected to the netting sheet with separate connectors, such as by using the anchor straps 88 as shown in FIG. 14.

The arched netting sheet 92 is prefabricated at a location other than the site where the control device 90 is to be used. Because of the relatively rigid nature of the arched netting sheet 82, a multiplicity of arched netting sheets 92 can be stacked or nested on top of one another and shipped or stored as a nested group without consuming excessive space. The bottom opening of the arched netting sheets 92 allows them to be stacked on top of one another, with the curved top portion of a lower control device 90 receiving the bottom opening of the arched netting sheet 92 of an upper control device 90. Nesting the prefabricated control devices 90 in this manner makes it economical to ship them in prefabricated form, because each control device does not consume excessive space. Similarly, control devices 90 with the arched netting sheets 92 can also be stored during time periods when they are not used by stacking the assembled devices in the same nested manner and transporting them in the nested arrangement to the storage location.

Because of practical limitations on the lengths of the arched netting sheets 92 which can be transported, it is usually necessary to position multiple control devices 90 in an end-to-end sequential row to obtain the desired windblown particle control effect, as illustrated in FIG. 17. With the plurality of the control devices 90 positioned in a row, their ends vertically adjoin one another. Each control device 90 is connected to the ground by the spikes 38. The aligned and vertically adjoining ends of the control devices 90 are connected with one another using linking connectors 102. The linking connectors 102 may be conventional ties or rings that are looped through adjoining apertures 96 and webs 94 of the arched netting sheets 92. Linking the adjacent ends of the control devices 90 together in this manner establishes a continuous integral row of the control devices. In this manner, multiple windblown particle control devices 90 may be positioned and oriented as desired to achieve the best windblown particle control effect.

Each control device 90, and each row of multiple control devices 90, can be conveniently and quickly repositioned, as necessary, to obtain the optimum particle control effects. The spikes 38 are easily removed from the apertures 100 in the tabs 98, and the linking connectors 102, if used, are disconnected. The control devices 90 are thereafter shifted to the new position, reattached to the ground 36 by the spikes 38 and connected to one another by the use of the linking connectors 102. When not in use, the control devices 30 can be disconnected from the ground and from one another, stacked or nested in the manner described, and then transported to the storage location.

One of the benefits of the windblown particle control device of the present invention is that its tubular configuration always presents two vertically extending components of the netting sheet to confront the wind. The two vertically extending components of the netting sheet result from the two opposite sides of the tubular configuration. The two separated vertical sides of the tubular configuration interact with one another to jointly contribute aerodynamic drag and turbulence altering effects, thereby enhancing the windblown particle control effects. The two vertically extending sides of the tubular configuration also make the windblown particle deposition and maintenance effects significantly independent of the direction of the wind, because the porosity and interaction of the two sides is similar over a relatively wide range of wind direction angles. A tangent to the curved surface in the transverse direction becomes increasingly horizontal with increasing height above the surface. This has the effect of decreasing the aerodynamic porosity of the material in the horizontal direction of the airflow. This vertically non-uniform horizontal porosity effect of the control devices reduces the wind speed to an even greater extent than would be the case with two parallel sheets of netting.

The tubular porous windblown particle control devices may be positioned in various arrays and configurations to achieve the desired type and degree of control over windblown particles. As previously noted, the predominant use of the windblown particle control devices is controlling blowing snow. Controlling and retaining or stabilizing windblown snow is very important to keeping roadways passable to traffic by preventing snow drifts and large accumulations which block the roadways to traffic flow. Controlling and retaining windblown snow is equally or more important to prevent icing on roadways, as would occur by the continuous sifting of snow across the roadway where the snow melts and then refreezes to form ice. Ice on roadways causes or contributes to vehicle crashes because of the inability of drivers to control their vehicles under icing conditions. The control devices can also be used to prevent snow from forming drifts over railroad tracks in cuts through hills, clogging railroad switches and interfering with electronic detectors. Other uses of the control devices may be to retain snow on disturbed lands so as to increase soil moisture to facilitate revegetation, retain snow on agricultural lands to increase crop yields, to increase snow available for recreational use such as on skiing trails, to reduce wind erosion of soil from agricultural lands and from topsoil storage piles, to reduce sources of fugitive dust associated with mining or road construction, and to reduce blowing sand on beaches and desert areas. Many other uses of the control devices are known and will be apparent.

In addition to the advantages of controlling the retention and deposition of windblown particles, each of the porous tubular windblown particle control devices offers the advantages of convenient and quick construction from relatively inexpensive and common materials. The cost of manufacturing the control devices is significantly less than the construction costs of many other types of snow fences. The construction of the control devices allows them to be conveniently assembled at the location of use, and disassembled when not in use. The anchoring system for the control devices is formed from relatively lightweight and common materials which can be easily transported to the location of use, and removed after the control devices are taken down and removed. Some forms of the control devices may be assembled away from the location of use and transported to the location of use, because of the ability to stack, roll up or nest the control devices relative to one another. When not in use, these types of control devices can be stored in a space-efficient compact manner because of their stacking, rolling or nesting capability. The control devices facilitate disassembly into the component parts and allow the component parts to be stored in a space efficient manner. Because of the relative simplicity of the control devices, it is relatively easy and time efficient to assemble and disassemble the control devices. Many other advantages and improvements will be apparent upon fully understanding the significance and aspects of the present invention.

Presently preferred embodiments of the invention and many of its improvements and benefits have been described with a degree of particularity. This description is of preferred examples of implementing the invention, and is not necessarily intended to limit the scope of the invention. The scope of the invention is defined by the following claims.

What is claimed is:

1. A porous tubular windblown particle control device for attachment to a surface of the earth to stabilize particle cover and to control deposition and retention of windblown particles, comprising:

an elongated sheet of netting material formed from a plurality of webs linked together to define apertures between the webs and through the sheet, the netting sheet having a longitudinal dimension and a transverse dimension;

a plurality of frame structures, each frame structure including at least one anchor element to connect the frame structure to the earth surface, each frame structure defining a geometric configuration having an open center with horizontal and vertical dimensions across the open center and an outer peripheral shape circumscribing the open center; and a connection of the sheet of netting material to the plurality of frame structures with the plurality of frame structures extending generally parallel to the transverse dimension of the elongated sheet of netting material and separated from one another in a longitudinally spaced apart relationship along the longitudinal dimension of the sheet of netting material and with the outer peripheral shape of each frame structure extending in the transverse dimension of the sheet of netting material;

the sheet of netting material assuming a generally tubular cross-sectional shape generally corresponding to the outer peripheral shape of the plurality of frame structures when connected to the frame structures;

the transverse dimension of the sheet of netting material is sufficient to extend the sheet of netting material over a substantial majority of the outer peripheral shape of the frame structures to locations adjacent the earth surface; and the sheet of netting material has sufficient inherent strength in the longitudinal dimension to maintain substantially the same generally tubular cross-sectional shape between the longitudinally spaced apart frame structures upon connecting the frame structures to the earth surface at the anchor elements.

2. A windblown particle control device as defined in claim 1, wherein:

the webs of the sheet of netting material are generally aligned with one another in the longitudinal direction.

3. A windblown particle control device as defined in claim 1, wherein:

the strength of the sheet of netting material is sufficient to maintain the same generally tubular cross-sectional shape between the longitudinally spaced apart frame structures without additional longitudinal reinforcement between the longitudinally spaced apart support structures.

4. A windblown particle control device as defined in claim 1, wherein:

the connection of the sheet material to the frame structures comprises a portion of the frame structures woven through apertures on opposite sides of webs along a transverse line of apertures in the sheet material.

5. A windblown particle control device as defined in claim 4, wherein:

each frame structure comprises a generally straight and bendable frame member which extends substantially transversely across the full transverse dimension of the sheet.

6. A windblown particle control device as defined in claim 5, wherein:

the anchor elements of each frame structure are connected to each end of the straight and bendable frame member at locations adjacent to transversely opposite and longitudinally extending edges of the elongated sheet.

7. A windblown particle control device as defined in claim 6, wherein:

each straight frame member bends into an arch curved above the surface of the earth to establish the generally tubular cross-sectional shape upon attachment of the anchor elements to the surface of the earth.

8. A windblown particle control device as defined in claim 7, wherein:

each straight frame member is resiliently bendable.

9. A windblown particle control device as defined in claim 8, wherein:

each straight frame member assumes a substantially straight elongated characteristic after disconnection of the anchor elements from the surface of the earth.

10. A windblown particle control device as defined in claim 7, wherein:

each straight frame member is a length of spring wire.

11. A windblown particle control device as defined in claim 1, wherein:

the longitudinal dimension of the sheet of netting material is multiple times greater than the transverse dimension of the sheet of netting material.

12. A windblown particle control device as defined in claim 11, wherein:

each separate connector encloses a web and the frame structure.

13. A windblown particle control device as defined in claim 1, wherein:

the connection of the sheet material to the frame structures comprises separate connectors which link webs of the sheet to the frame structures.

14. A windblown particle control device as defined in claim 1, wherein:

the webs of the sheet of netting material comprise a spaced-apart series of parallel transversely-extending main support ribs and a spaced-part series of parallel longitudinally-extending stringers which intersect the main support ribs approximately perpendicularly, the main support ribs having strength and rigidity characteristics which permit bending of the main support ribs and the sheet in an arch from one transverse side of the sheet to the other transverse side of the sheet, the strength and rigidity characteristics of the main support ribs also being sufficient to self-support the netting sheet in the generally tubular cross-sectional shape when the main support ribs are bent in the arch from one transverse side of the sheet to the other transverse side of the sheet; and the frame structures comprise the main support ribs.

15. A windblown particle control device as defined in claim 14, wherein:

the main support ribs constitute the frame structures.

16. A windblown particle control device as defined in claim 15, wherein:

the anchor elements are connected to the opposite ends of the main support ribs which extend transversely across the sheet.

17. A windblown particle control device as defined in claim 15, wherein:

the anchor elements are connected to the transversely opposite and longitudinally extending edges of the elongated sheet.

18. A windblown particle control device as defined in claim 15, wherein:

the plurality of stringers are of less strength than the support ribs; and the support ribs and stringers circumscribe and define the apertures.

19. A windblown particle control device as defined in claim 18, wherein:

the elongated sheet is formed from one of geogrid or geotextile material which each have support ribs and stringers.

20. A windblown particle control device as defined in claim 14, wherein:

the transverse dimension of the sheet of netting material is sufficient to extend the sheet of netting material around the outer peripheral shape of each frame structure to a position where transversely opposite longitudinal edges of the sheet of netting material are spaced above the earth surface when the sheet occupies the generally tubular cross-sectional shape.

21. A windblown particle control device as defined in claim 1, wherein:

the webs of the sheet of netting material are formed from substantially rigid material, the webs of the sheet which extend in the transverse dimension having a permanently curved configuration to establish the generally tubular cross-sectional shape of the sheet, the webs of the sheet which extend in the longitudinal dimension having a permanently and substantially straight configuration, the strength and rigidity the webs also being sufficient to self-support the netting sheet in the generally tubular cross-sectional shape when the sheet is bent in the arch from one transverse side of the sheet to the other transverse side of the sheet; and the frame structures comprise the webs which extend in the transverse dimension across the sheet.

22. A windblown particle control device as defined in claim 21, wherein:

the webs which extend in the transverse dimension across the sheet constitute the frame structures.

23. A windblown particle control device as defined in claim 22, wherein:

the anchor elements are connected to at least some of the webs which extend in the transverse dimension across the sheet at the transversely opposite and longitudinally extending edges of the elongated sheet.

24. A windblown particle control device as defined in claim 22, wherein:

the anchor elements are connected to the transversely opposite and longitudinally extending edges of the elongated sheet.

25. A windblown particle control device as defined in claim 22, wherein:

the elongated sheet and the webs are formed from cured synthetic composite material.

26. A windblown particle control device as defined in claim 22, wherein:

the elongated sheet and the webs are formed from cured fiberglass material.

27. A method of controlling particle cover stabilization and deposition and retention of particles blown by wind in a location on an earth surface that is to be protected, comprising:

locating a porous tubular windblown particle control device relative to the area that is to be protected, the windblown particle control device comprising a sheet of netting material curved in an arched configuration to establish a generally tubular cross-sectional shape upon contact with the earth surface, the sheet comprising a plurality of webs linked together to define apertures between the webs and through the sheet;

positioning the control device in contact with the earth surface and with a longitudinal axis of the arched configuration extending generally parallel to the earth surface; and orienting the arched configuration of the sheet to confront the wind and cause the windblown particles to flow through the apertures of two generally upright portions of the arched configuration of the sheet and create aerodynamic effects which stabilize, deposit and retain the particles on the earth surface in the protected area.

28. A method as defined in claim 27, wherein:

the sheet of netting material has sufficient inherent strength to self-support and self-maintain the arched configuration to establish the generally tubular cross-sectional shape when the control device is positioned in contact with the earth surface.

29. A method as defined in claim 28, wherein:

the sheet of netting material has sufficient strength to self-support and self-maintain substantially the same arched configuration along a longitudinal dimension of the sheet.

30. A method as defined in claim 28, wherein:

the sheet constitutes one of either a geogrid material or a geotextile material.

31. A method as defined in claim 28, wherein:

the sheet and the webs are formed from cured synthetic composite material.

32. A method as defined in claim 28, wherein:

the sheet and the webs are formed from cured fiberglass material.

33. A method as defined in claim 27, further comprising:

anchor elements connected to the sheet at transversely opposite and longitudinally extending edges of the sheet and operative to connect the sheet to the earth surface in the arched configuration.

34. A method as defined in claim 27, wherein:

the sheet has a longitudinal dimension and a transverse dimension, the longitudinal and transverse dimensions extend perpendicular to one another, the arched configuration extends in the transverse dimension, and the longitudinal dimension has a length which is at least two times a length of the transverse dimension.

35. A method as defined in claim 34, wherein:

the webs of the sheet are generally aligned with one another along the longitudinal dimension.

36. A method as defined in claim 27, further comprising:

a frame structure extending transversely across the sheet in approximately the same arched configuration as the sheet.

37. A method as defined in claim 36, wherein:

the frame structure is formed from a wire.

38. A method as defined in claim 37, wherein:

the wire is woven through apertures on opposite sides of webs along a transverse line of apertures across the sheet.

39. A method as defined in claim 38, wherein:

the wire is resiliently bendable.

40. A method as defined in claim 36, wherein:

the frame structure comprises a generally straight and bendable frame member which extends substantially transversely across the full transverse dimension of the sheet.

41. A method as defined in claim 40, wherein:

the straight frame member bends into the arched configuration above the earth surface to establish the generally tubular cross-sectional shape upon attachment of ends of the frame member to the earth surface.

42. A method as defined in claim 41, wherein:

the straight frame member is resiliently bendable into the arched configuration.

43. A method as defined in claim 42, wherein:

the straight frame member assumes a substantially straight elongated characteristic after disconnection of the ends of the frame member from the earth surface.

44. A method as defined in claim 41, wherein:

the straight frame member is a length of spring wire.

45. A kit of components to be connected together to form a porous tubular windblown particle control device which when attached to a surface of the earth stabilizes particle cover and controls deposition and retention of windblown particles, comprising:

a sheet of netting material comprising a plurality of webs linked together to define apertures between the webs and through the sheet; and a plurality of frame structures with which to support and maintain the sheet of netting material in an arched configuration by attaching the sheet to the frame structures when longitudinally spaced apart at positions along the sheet to establish a generally tubular cross-sectional shape of the sheet upon contact of the frame structures with the surface of the earth; and wherein:

each of the frame structures is a generally straight and bendable frame member which is bent into the arched configuration above the earth surface; and the sheet is to be attached to a peripheral portion of the frame material which is bent into the arched configuration.

46. A kit defined in claim 45, wherein:

the straight frame member bends into the arched configuration above the surface of the earth to establish the generally tubular cross-sectional shape upon attaching ends of the frame member to the surface of the earth.

47. A kit as defined in claim 46, wherein:

the straight frame member is resiliently bendable into the arched configuration.

48. A kit as defined in claim 47, wherein:

the straight frame member assumes a substantially straight elongated characteristic after disconnection of the ends of the frame member from the surface of the earth.

49. A kit as defined in claim 46, wherein:

the straight frame member is a length of resilient spring wire.

50. A kit as defined in claim 49, wherein:

the sheet is to be attached to the wire by weaving the wire through apertures on opposite sides of webs along a transverse line of apertures across the sheet.

51. A kit as defined in claim 46, wherein:

the sheet is to be attached to the straight and bendable frame member by weaving the frame member through apertures on opposite sides of webs along a transverse line of apertures across the sheet.

52. A method of assembling a porous tubular windblown particle control device from the kit defined in claim 45, the windblown particle control device stabilizing particle cover and controlling deposition and retention of windblown particles when attached to a surface of the earth, the method comprising:

orienting the sheet with the frame structures extending transversely across the sheet bending each of the straight frame structures to establish the arched configuration along the length of the frame structures and transversely across the sheet; and holding each bent frame structure and the sheet in the arched configuration by retaining ends of the frame structures to the earth after each frame structure and the sheet have been bent into the arched configuration.

53. A method as defined in claim 52, further comprising:

retaining ends of the frame structures to the earth along one longitudinal edge of the sheet; and moving the opposite ends of the frame structures toward the retained ends of the frame structures to bend each of the straight frame structures and the connected sheet into the arched configuration.

54. A method as defined in claim 53, further comprising:

moving the opposite ends of the frame structures toward the retained ends in incremental stages to increase the degree of curvature of the arched configuration.

55. A method as defined in claim 54, further comprising:

retaining the opposite ends of the frame structures to the surface of the earth upon the incremental movement of the opposite ends achieving a predetermined final degree of curvature of the frame structures in the arched configuration.

56. A method as defined in claim 55, further comprising:

extending a longitudinal restraints along transversely opposite longitudinal edges of the sheet; and contacting opposite ends of the frame structures with the longitudinal restraints to retain the ends of the frame structures to the earth surface along both longitudinal edges of the sheet.

57. A method as defined in claim 53, further comprising:

extending a longitudinal restraint along the one longitudinal edge of the sheet; and contacting the ends of the frame structures with the longitudinal restraint to retain the ends of the frame structures to the earth surface along the one longitudinal edge of the sheet.

58. A method as defined in claim 52, further comprising:

releasing the ends of the frame structures from retention with the earth surface after the frame structures and the sheet have been bent into and maintained in the arched configuration; and allowing the resilience of the frame structures to establish a substantially straight elongated characteristic of the frame structures and a substantially planar characteristic of the sheet after disconnecting the ends of the frame structures from the surface of the earth.

59. A method as defined in claim 58, further comprising:

stacking a plurality of the sheets and the integral frame structures on top of one another while each sheet has the substantially planar characteristic and while each frame structure has the substantially straight characteristic.

60. A method as defined in claim 58, further comprising:

rolling the substantially planar sheet with substantially straight the frame structures woven through its apertures into a roll with an axis of the roll extending generally parallel to each of the straight frame structures.

61. A kit of components to be connected together to form a porous tubular windblown particle control device which when attached to a surface of the earth stabilizes particle cover and controls deposition and retention of windblown particles, comprising:

a sheet of netting material comprising a plurality of webs linked together to define apertures between the webs and through the sheet; and a plurality of frame structures with which to support and maintain the sheet of netting material in an arched configuration by attaching the sheet to the frame structures when longitudinally spaced apart at positions along the sheet to establish a generally tubular cross-sectional shape of the sheet upon contact of the frame structures with the surface of the earth; and wherein:

the frame structures are integrally attached to the sheet;

the frame structures extend integrally transversely across the sheet; and the integrally attached frame structures comprise a spaced-apart series of parallel transversely-extending main support ribs having strength and rigidity characteristics which permit bending of the main support ribs and the sheet in an arch from one transverse side of the sheet to the other transverse side of the sheet, the strength and rigidity characteristics of the main support ribs being sufficient to self-support the sheet in the generally tubular cross-sectional shape when the main support ribs are bent in the arch from one transverse side of the sheet to the other transverse side of the sheet.

62. A kit as defined in claim 61, wherein:

the sheet also comprises a series of spaced-apart, parallel, longitudinally-extending stringers which intersect the main support ribs approximately perpendicularly and which extend longitudinally along the generally tubular cross-sectional shape of the sheet.

63. A kit as defined in claim 61, wherein:

the sheet constitutes one of either geogrid material or geotextile material.

64. A kit as defined in claim 61, wherein:

the integrally attached frame members comprise the webs of the sheet formed from substantially rigid material, the webs of the sheet which extend in the transverse dimension having a permanent curve in the arched configuration, the webs of the sheet which extend in the longitudinal dimension having a permanently and substantially straight configuration, the strength and rigidity the webs being sufficient to self-support the sheet in the generally tubular cross-sectional shape when the sheet is bent in the arched configuration from one transverse side of the sheet to the other transverse side of the sheet.

65. A kit as defined in claim 64, wherein:

the sheet and the webs are formed from cured synthetic composite material.

66. A kit as defined in claim 61, wherein:

the sheet has a longitudinal dimension and a transverse dimension, the longitudinal and transverse dimensions extend perpendicular to one another, the arched configuration extends in the transverse dimension, and the longitudinal dimension has a length which is at least two times a length of the transverse dimension.

67. A method of controlling particle cover stabilization and deposition and retention of particles blown by wind in a location on an earth surface that is to be protected, comprising:

locating a porous tubular windblown particle control device assembled from the kit defined in claim 61 relative to the area that is to be protected;

positioning the control device with a longitudinal axis of the porous tubular configuration extending generally parallel to the earth surface; and orienting the tubular configuration of the sheet to confront the wind and cause the wind blown particles to flow through the apertures of two vertically oriented portions of the tubular configuration of the sheet and create aerodynamic effects which stabilize, deposit and retain the particles on the earth surface in the protected area.

68. A method as defined in claim 67, further comprising:

depositing and retaining the particles substantially only in the protected area.

69. A method as defined in claim 67, further comprising:
orienting the tubular configuration with the longitudinal axis generally perpendicular to a prevailing wind direction.

70. A method as defined in claim 67, further comprising:
positioning a plurality of the control devices in a row to deposit, stabilize, and retain the windblown particles in a protected area that is larger than the area capable of being protected by a single control device.

71. A method as defined in claim 67, further comprising:
positioning the plurality of the control devices end-to-end in a continuous row.

72. A kit of components to be connected together to form a porous tubular windblown particle control device which when attached to a surface of the earth stabilizes particle cover and controls deposition and retention of windblown particles, comprising:
a sheet of netting material comprising a plurality of webs linked together to define apertures between the webs and through the sheet;
a plurality of frame structures with which to support and maintain the sheet of netting material in an arched configuration by attaching the sheet to the frame structures when longitudinally spaced apart at positions along the sheet to establish a generally tubular cross-sectional shape of the sheet upon contact of the frame structures with the surface of the earth; and
a longitudinal restraint connectable to the frame structures to retain the frame structures to the surface of the earth and longitudinally spaced along the generally tubular cross-sectional shape of the sheet upon contact of the frame structures with the surface of the earth.

73. A kit as defined in claim 72, wherein:
the longitudinal restraint includes a plurality of restraint connectors attached thereto to connect the longitudinal restraint to the earth surface.

74. A kit as defined in claim 73, wherein:
each restraint connector is adapted to receive a fastener to connect the restraint element to the earth surface.

75. A kit as defined in claim 74, further comprising:
at least one fastener associated with each restraint connector.

76. A kit of components to be connected together to form a porous tubular windblown particle control device which when attached to a surface of the earth stabilizes particle cover and controls deposition and retention of windblown particles, comprising:
a sheet of netting material comprising a plurality of webs linked together to define apertures between the webs and through the sheet;
a plurality of frame structures with which to support and maintain the sheet of netting material in an arched configuration by attaching the sheet to the frame structures when longitudinally spaced apart at positions along the sheet to establish a generally tubular cross-sectional shape of the sheet upon contact of the frame structures with the surface of the earth; and
a plurality of fasteners connectable to the frame structures to attach the frame structures to the surface of the earth.

77. A kit as defined in claim 76, wherein:
each of the frame structures is D-shaped; and
the sheet is to be attached at a peripheral portion of the D-shaped frame structure formed by an upper semicircular portion and straight leg portions extending downward from ends of the semicircular portion.

78. A kit as defined in claim 76, wherein:
each of the frame structures is U-shaped; and
the sheet is to be attached at a peripheral portion of the U-shaped frame structure formed by an upper semicircular portion and straight leg portions extending downward from ends of the semicircular portion.

79. A kit as defined in claim 76, wherein:
each frame structure includes at least one anchor element connected to the frame structure at a location to contact the earth surface.

80. A kit as defined in claim 79, wherein:
the anchor element is adapted to receive a fastener to connect the anchor element and the frame structure to the earth surface.

81. A kit as defined in claim 80, further comprising:
at least one fastener associated with each frame structure.

82. A kit as defined in claim 76, further comprising:
a longitudinal restraint connectable to the frame structures to retain the frame structures to the surface of the earth and longitudinally spaced along the generally tubular cross-sectional shape of the sheet upon contact of the frame structures with the surface of the earth.

83. A method of assembling a porous tubular windblown particle control device from the kit defined in claim 76, the windblown particle control device stabilizing particle cover and controlling deposition and retention of windblown particles when attached to a surface of the earth, the method comprising:
connecting the plurality of frame structures to the sheet of netting material with each frame member extending transversely across the sheet and longitudinally spaced along the sheet from an adjacent frame member;
attaching the frame structures to the earth surface with the fasteners; and
orienting the frame structures to extend upward from the surface of the earth in an arched configuration to support and maintain the sheet of netting material in the generally tubular cross-sectional shape.

84. A method as defined in claim 83, further comprising:
attaching the frame structures to the surface of the earth after connecting the plurality of frame structures to the sheet.

85. A method as defined in claim 83, further comprising:
connecting the frame structures to the sheet by weaving each frame structure through apertures on opposite sides of webs along a line of apertures in the sheet.

86. A method as defined in claim 83, wherein each of the frame structures is a generally straight and bendable frame member, and the method further comprises:
connecting the plurality of frame structures to the sheet by weaving each frame member through apertures on opposite sides of webs along a transverse line of apertures across the sheet.

87. A method as defined in claim 86, further comprising:
bending each of the straight frame members into the arched configuration above the earth surface after each frame member has been woven through the apertures of the sheet.

88. A method as defined in claim 87, further comprising:
attaching ends of the frame members to the earth surface after each frame member has been bent into the arched configuration.

89. A method as defined in claim 88, wherein each straight frame member is resiliently bendable, and the method further comprises:
holding each bent frame member in the arched configuration by attaching the ends of the frame members to the earth surface after each frame member has been bent into the arched configuration.

90. A method as defined in claim 89, further comprising:

disconnecting the ends of the frame members from the earth surface after the straight frame members have been bent into and maintained in the arched configuration; and allowing the resilience of the frame members to establish a substantially straight elongated characteristic of the frame members after disconnecting the ends of the frame members from the surface of the earth.

91. A method as defined in claim 90, further comprising:

maintaining the frame members woven through the apertures of the sheet when the frame members assume the substantially straight elongated characteristic; and allowing the sheet to assume a substantially planar characteristic as the frame members assume the substantially straight elongated characteristic.

92. A method as defined in claim 91, further comprising:

stacking a plurality of the sheets on top of one another while each sheet has the substantially planar characteristic with the substantially straight frame members woven through its apertures.

93. A method as defined in claim 91, further comprising:

rolling the substantially planar sheet with substantially straight the frame members woven through its apertures into a roll with an axis of the roll extending generally parallel to each of the straight frame members.

94. A method as defined in claim 88, further comprising:

disconnecting the ends of the frame members from the earth surface after the straight frame members have been bent into and maintained in the arched configuration; and straightening the frame members to establish a substantially straight elongated characteristic of the frame members after disconnecting the ends of the frame members from the surface of the earth.

95. A method as defined in claim 94, further comprising:

maintaining the frame members woven through the apertures of the sheet when the frame members are straightened into the substantially straight elongated characteristic; and allowing the sheet to assume a substantially planar characteristic as the frame members assume the substantially straight elongated characteristic.

96. A method as defined in claim 95, further comprising:

stacking a plurality of the sheets on top of one another while each sheet has the substantially planar characteristic with the substantially straight frame members woven through its apertures.

97. A method as defined in claim 95, further comprising:

rolling the substantially planar sheet with the substantially straight frame members woven through its apertures into a roll with an axis of the roll extending generally parallel to each of the straight frame members.

98. A method as defined in claim 87, wherein each straight frame member is resiliently bendable, and the method further comprises:

attaching ends of the frame members to the earth surface along one longitudinal edge of the sheet; and moving the opposite ends of the frame members toward the attached ends of the frame members to bend each of the straight frame members and the connected sheet into the arched configuration.

99. A method as defined in claim 98, further comprising:

moving the opposite ends of the frame members toward the attached ends in incremental stages to increase the degree of curvature of the arched configuration.

100. A method as defined in claim 99, further comprising:

attaching the opposite ends of the frame members to the surface of the earth upon the incremental movement of the opposite ends achieving a predetermined final degree of curvature of the frame members in the arched configuration.

101. A method as defined in claim 83, wherein each of the frame structures is generally U-shaped, and the method further comprises:

connecting the plurality of frame structures to the sheet by weaving each U-shaped frame member through apertures on opposite sides of webs along a transverse line of apertures across the sheet.

102. A method as defined in claim 101, further comprising:

weaving an upper semicircular portion and straight leg portions extending downward from ends of the semicircular portion of the U-shaped frame structure through the apertures.

103. A method as defined in claim 102, wherein each of the frame structures is generally D-shaped formed by the U-shaped frame structure to which a base portion is attached between downward ends of the straight leg portions.

104. A method of controlling particle cover stabilization and deposition and retention of particles blown by wind in a location on an earth surface that is to be protected, comprising:

locating a porous tubular windblown particle control device assembled by the method defined in claim 83 relative to the area that is to be protected;

positioning the control device with a longitudinal axis of the porous tubular configuration extending generally parallel to the earth surface; and orienting the tubular configuration of the sheet to confront the wind and cause the wind blown particles to flow through the apertures of two vertically oriented portions of the tubular configuration of the sheet and create aerodynamic effects which stabilize, deposit and retain the particles on the earth surface in the protected area.

105. A method as defined in claim 64, further comprising:

depositing and retaining the particles substantially only in the protected area.

106. A method as defined in claim 64, further comprising:

orienting the tubular configuration with the longitudinal axis generally perpendicular to a prevailing wind direction.

107. A method as defined in claim 64, further comprising:

positioning a plurality of the control devices in a row to deposit, stabilize, and retain the windblown particles in a protected area that is larger than the area capable of being protected by a single control device.

108. A method as defined in claim 107, further comprising:

positioning the plurality of the control devices end-to-end in a continuous row.

109. A method of controlling particle cover stabilization and deposition and retention of particles blown by wind in a location on an earth surface that is to be protected, comprising:

locating a porous tubular windblown particle control device assembled by the method defined in claim 52 relative to the area that is to be protected;

positioning the control device with a longitudinal axis of the porous tubular configuration extending generally parallel to the earth surface; and orienting the tubular configuration of the sheet to confront the wind and cause the wind blown particles to flow through the apertures of two vertically oriented portions of the tubular configuration of the sheet and create aerodynamic effects which stabilize, deposit and retain the particles on the earth surface in the protected area.

110. A method as defined in claim 109, further comprising:

depositing and retaining the particles substantially only in the protected area.

111. A method as defined in claim 109, further comprising:

orienting the tubular configuration with the longitudinal axis generally perpendicular to a prevailing wind direction.

112. A method as defined in claim 109, further comprising:

positioning a plurality of the control devices in a row to deposit, stabilize, and retain the windblown particles in a protected area that is larger than the area capable of being protected by a single control device.

113. A method as defined in claim 109, further comprising:

positioning the plurality of the control devices end-to-end in a continuous row.

* * * * *